US008770284B2

(12) United States Patent
Meurer et al.

(10) Patent No.: US 8,770,284 B2
(45) Date of Patent: Jul. 8, 2014

(54) SYSTEMS AND METHODS OF DETECTING AN INTERSECTION BETWEEN A WELLBORE AND A SUBTERRANEAN STRUCTURE THAT INCLUDES A MARKER MATERIAL

(71) Applicants: William P. Meurer, Pearland, TX (US); Chen Fang, Houston, TX (US); Federico G. Gallo, Houston, TX (US); Nazish Hoda, Houston, TX (US); Michael W. Lin, Houston, TX (US)

(72) Inventors: William P. Meurer, Pearland, TX (US); Chen Fang, Houston, TX (US); Federico G. Gallo, Houston, TX (US); Nazish Hoda, Houston, TX (US); Michael W. Lin, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 13/866,833

(22) Filed: Apr. 19, 2013

(65) Prior Publication Data

US 2013/0292177 A1 Nov. 7, 2013

Related U.S. Application Data

(60) Provisional application No. 61/642,811, filed on May 4, 2012.

(51) Int. Cl.
*E21B 36/04* (2006.01)
*E21B 43/24* (2006.01)

(52) U.S. Cl.
CPC ..... *E21B 36/04* (2013.01); *E21B 43/2401* (2013.01)
USPC ..... 166/254.1; 166/272.1; 166/60; 166/248; 166/250.12

(58) Field of Classification Search
CPC ..... E21B 31/06; E21B 47/00; E21B 47/04; E21B 7/15; E21B 36/04; E21B 43/2401
USPC ..... 166/254.1, 272.1, 272.2, 302, 60, 248, 166/250.12
See application file for complete search history.

(56) References Cited

U.S. PATENT DOCUMENTS 363,419 A 5/1887 Poetsch
895,612 A 8/1908 Baker (Continued)

FOREIGN PATENT DOCUMENTS

CA 994694 8/1976
CA 1288043 8/1991

(Continued)

OTHER PUBLICATIONS

Anderson, R., et al (2003) "Power Generation with 100% Carbon Capture Sequestration" 2nd Annual Conference on Carbon Sequestration, Alexandria, VA.

(Continued)

*Primary Examiner* — Cathleen Hutchins
(74) *Attorney, Agent, or Firm* — ExxonMobil Upstream Research Company-Law Department

(57) ABSTRACT

Systems and methods of detecting an intersection between a wellbore and a subterranean structure that includes a marker material. The systems and methods include drilling the wellbore and determining that the wellbore has intersected a portion of the subterranean structure that includes the marker material by detecting the marker material. The systems and methods also may include distributing the marker material within the subterranean structure, aligning the marker material within the subterranean structure, determining one or more characteristics of the marker material, ceasing the drilling, repeating the method, and/or producing a hydrocarbon from the subterranean structure. The systems and methods further may include forming an electrical connection between an electric current source and a granular resistive heater that forms a portion of the subterranean structure, forming the granular resistive heater, and/or forming the subterranean structure.

27 Claims, 7 Drawing Sheets

(56) References Cited

U.S. PATENT DOCUMENTS

| | | | |
|---|---|---|---|
| 1,342,780 | A | 6/1920 | Vedder |
| 1,422,204 | A | 7/1922 | Hoover et al. |
| 1,666,488 | A | 4/1928 | Crawshaw |
| 1,701,884 | A | 2/1929 | Hogle |
| 1,872,906 | A | 8/1932 | Doherty |
| 2,033,560 | A | 3/1936 | Wells |
| 2,033,561 | A | 3/1936 | Wells |
| 2,534,737 | A | 12/1950 | Rose |
| 2,584,605 | A | 2/1952 | Merriam et al. |
| 2,634,961 | A | 4/1953 | Ljungstrom |
| 2,732,195 | A | 1/1956 | Ljungstrom |
| 2,777,679 | A | 1/1957 | Ljungstrom |
| 2,780,450 | A | 2/1957 | Ljungstrom |
| 2,795,279 | A | 6/1957 | Sarapuu |
| 2,812,160 | A | 11/1957 | West et al. |
| 2,813,583 | A | 11/1957 | Marx et al. |
| 2,847,071 | A | 8/1958 | De Priester |
| 2,887,160 | A | 5/1959 | De Priester |
| 2,895,555 | A | 7/1959 | De Priester |
| 2,923,535 | A | 2/1960 | Ljungstrom |
| 2,944,803 | A | 7/1960 | Hanson |
| 2,952,450 | A | 9/1960 | Purre |
| 2,974,937 | A | 3/1961 | Kiel |
| 3,004,601 | A | 10/1961 | Bodine |
| 3,013,609 | A | 12/1961 | Brink |
| 3,095,031 | A | 6/1963 | Eurenius et al. |
| 3,106,244 | A | 10/1963 | Parker |
| 3,109,482 | A | 11/1963 | O'Brien |
| 3,127,936 | A | 4/1964 | Eurenius |
| 3,137,347 | A | 6/1964 | Parker |
| 3,149,672 | A | 9/1964 | Orkiszewski et al. |
| 3,170,815 | A | 2/1965 | White |
| 3,180,411 | A | 4/1965 | Parker |
| 3,183,675 | A | 5/1965 | Schroeder |
| 3,183,971 | A | 5/1965 | McEver et al. |
| 3,194,315 | A | 7/1965 | Rogers |
| 3,205,942 | A | 9/1965 | Sandberg |
| 3,225,829 | A | 12/1965 | Chown et al. |
| 3,228,869 | A | 1/1966 | Irish |
| 3,241,611 | A | 3/1966 | Dougan |
| 3,241,615 | A | 3/1966 | Brandt et al. |
| 3,254,721 | A | 6/1966 | Smith et al. |
| 3,256,935 | A | 6/1966 | Nabor et al. |
| 3,263,211 | A | 7/1966 | Heidman |
| 3,267,680 | A | 8/1966 | Schlumberger |
| 3,271,962 | A | 9/1966 | Dahms et al. |
| 3,284,281 | A | 11/1966 | Thomas |
| 3,285,335 | A | 11/1966 | Reistle, Jr. |
| 3,288,648 | A | 11/1966 | Jones |
| 3,294,167 | A | 12/1966 | Vogel |
| 3,295,328 | A | 1/1967 | Bishop |
| 3,323,840 | A | 6/1967 | Mason et al. |
| 3,358,756 | A | 12/1967 | Vogel |
| 3,372,550 | A | 3/1968 | Schroeder |
| 3,376,403 | A | 4/1968 | Mircea |
| 3,382,922 | A | 5/1968 | Needham |
| 3,400,762 | A | 9/1968 | Peacock et al. |
| 3,436,919 | A | 4/1969 | Shock et al. |
| 3,439,744 | A | 4/1969 | Bradley |
| 3,455,392 | A | 7/1969 | Prats |
| 3,461,957 | A | 8/1969 | West |
| 3,468,376 | A | 9/1969 | Slusser et al. |
| 3,494,640 | A | 2/1970 | Coberly et al. |
| 3,500,913 | A | 3/1970 | Nordgren et al. |
| 3,501,201 | A | 3/1970 | Closmann et al. |
| 3,502,372 | A | 3/1970 | Prats |
| 3,513,914 | A | 5/1970 | Vogel |
| 3,515,213 | A | 6/1970 | Prats |
| 3,516,495 | A | 6/1970 | Patton |
| 3,521,709 | A | 7/1970 | Needham |
| 3,528,252 | A | 9/1970 | Gail |
| 3,528,501 | A | 9/1970 | Parker |
| 3,547,193 | A | 12/1970 | Gill |
| 3,559,737 | A | 2/1971 | Ralstin |
| 3,572,838 | A | 3/1971 | Templeton |
| 3,592,263 | A | 7/1971 | Nelson |
| 3,599,714 | A | 8/1971 | Messman |
| 3,602,310 | A | 8/1971 | Halbert |
| 3,613,785 | A | 10/1971 | Closmann et al. |
| 3,620,300 | A | 11/1971 | Crowson |
| 3,642,066 | A | 2/1972 | Gill |
| 3,661,423 | A | 5/1972 | Garret |
| 3,692,111 | A | 9/1972 | Breithaupt et al. |
| 3,695,354 | A | 10/1972 | Dilgren et al. |
| 3,700,280 | A | 10/1972 | Papadopoulos et al. |
| 3,724,225 | A | 4/1973 | Mancini et al. |
| 3,724,543 | A | 4/1973 | Bell et al. |
| 3,729,965 | A | 5/1973 | Gartner |
| 3,730,270 | A | 5/1973 | Allred |
| 3,739,851 | A | 6/1973 | Beard |
| 3,741,306 | A | 6/1973 | Papadopoulos |
| 3,759,328 | A | 9/1973 | Ueber et al. |
| 3,759,329 | A | 9/1973 | Ross |
| 3,759,574 | A | 9/1973 | Beard |
| 3,779,601 | A | 12/1973 | Beard |
| 3,880,238 | A | 4/1975 | Tham et al. |
| 3,882,937 | A | 5/1975 | Robinson |
| 3,882,941 | A | 5/1975 | Pelofsky |
| 3,888,307 | A | 6/1975 | Closmann |
| 3,924,680 | A | 12/1975 | Terry |
| 3,943,722 | A | 3/1976 | Ross |
| 3,948,319 | A | 4/1976 | Pritchett |
| 3,950,029 | A | 4/1976 | Timmins |
| 3,958,636 | A | 5/1976 | Perkins |
| 3,967,853 | A | 7/1976 | Closmann et al. |
| 3,978,920 | A | 9/1976 | Bandyopadhyay |
| 3,999,607 | A | 12/1976 | Pennington et al. |
| 4,003,432 | A | 1/1977 | Paull et al. |
| 4,005,750 | A | 2/1977 | Shuck |
| 4,007,786 | A | 2/1977 | Schlinger |
| 4,008,762 | A | 2/1977 | Fisher et al. |
| 4,008,769 | A | 2/1977 | Chang |
| 4,014,575 | A | 3/1977 | French et al. |
| 4,030,549 | A | 6/1977 | Bouck |
| 4,037,655 | A | 7/1977 | Carpenter |
| 4,043,393 | A | 8/1977 | Fisher et al. |
| 4,047,760 | A | 9/1977 | Ridley |
| 4,057,510 | A | 11/1977 | Crouch et al. |
| 4,065,183 | A | 12/1977 | Hill et al. |
| 4,067,390 | A | 1/1978 | Camacho et al. |
| 4,069,868 | A | 1/1978 | Terry |
| 4,071,278 | A | 1/1978 | Carpenter et al. |
| 4,093,025 | A | 6/1978 | Terry |
| 4,096,034 | A | 6/1978 | Anthony |
| 4,125,159 | A | 11/1978 | Vann |
| 4,140,180 | A | 2/1979 | Bridges et al. |
| 4,148,359 | A | 4/1979 | Laumbach et al. |
| 4,149,595 | A | 4/1979 | Cha |
| 4,160,479 | A | 7/1979 | Richardson et al. |
| 4,163,475 | A | 8/1979 | Cha et al. |
| 4,167,291 | A | 9/1979 | Ridley |
| 4,169,506 | A | 10/1979 | Berry |
| 4,185,693 | A | 1/1980 | Crumb et al. |
| 4,186,801 | A | 2/1980 | Madgavkar et al. |
| 4,193,451 | A | 3/1980 | Dauphine |
| 4,202,168 | A | 5/1980 | Acheson et al. |
| 4,239,283 | A | 12/1980 | Ridley |
| 4,241,952 | A | 12/1980 | Ginsburgh |
| 4,246,966 | A | 1/1981 | Stoddard et al. |
| 4,250,230 | A | 2/1981 | Terry |
| 4,265,310 | A | 5/1981 | Britton et al. |
| 4,271,905 | A | 6/1981 | Redford et al. |
| 4,272,127 | A | 6/1981 | Hutchins |
| 4,285,401 | A | 8/1981 | Erickson |
| RE30,738 | E | 9/1981 | Bridges et al. |
| 4,318,723 | A | 3/1982 | Holmes et al. |
| 4,319,635 | A | 3/1982 | Jones |
| 4,320,801 | A | 3/1982 | Rowland et al. |
| 4,324,291 | A | 4/1982 | Wong et al. |
| 4,340,934 | A | 7/1982 | Segesman |
| 4,344,485 | A | 8/1982 | Butler |
| 4,344,840 | A | 8/1982 | Kunesh |
| 4,353,418 | A | 10/1982 | Hoekstra et al. |
| 4,358,222 | A | 11/1982 | Landau |

(56) References Cited

U.S. PATENT DOCUMENTS 4,362,213 A 12/1982 Tabor
4,368,921 A 1/1983 Hutchins
4,369,842 A 1/1983 Cha
4,372,615 A 2/1983 Ricketts
4,375,302 A 3/1983 Kalmar
4,384,614 A 5/1983 Justheim
4,396,211 A 8/1983 McStravick et al.
4,397,502 A 8/1983 Hines
4,401,162 A 8/1983 Osborne
4,412,585 A 11/1983 Bouck
4,417,449 A 11/1983 Hegarty et al.
4,449,585 A 5/1984 Bridges et al.
4,468,376 A 8/1984 Suggitt
4,470,459 A 9/1984 Copland
4,472,935 A 9/1984 Acheson et al.
4,473,114 A 9/1984 Bell et al.
4,474,238 A 10/1984 Gentry et al.
4,476,926 A 10/1984 Bridges et al.
4,483,398 A 11/1984 Peters et al.
4,485,869 A 12/1984 Sresty et al.
4,487,257 A 12/1984 Dauphine
4,487,260 A 12/1984 Pittman et al.
4,495,056 A 1/1985 Venardos
4,511,382 A 4/1985 Valencia et al.
4,532,991 A 8/1985 Hoekstra et al.
4,533,372 A 8/1985 Valencia et al.
4,537,067 A 8/1985 Sharp et al.
4,545,435 A 10/1985 Bridges et al.
4,546,829 A 10/1985 Martin et al.
4,550,779 A 11/1985 Zakiewicz
4,552,214 A 11/1985 Forgac et al.
4,567,945 A 2/1986 Segalman
4,585,063 A 4/1986 Venardos et al.
4,589,491 A 5/1986 Perkins
4,589,973 A 5/1986 Minden
4,602,144 A 7/1986 Vogel
4,607,488 A 8/1986 Karinthi et al.
4,626,665 A 12/1986 Fort
4,633,948 A 1/1987 Closmann
4,634,315 A 1/1987 Owen et al.
4,637,464 A 1/1987 Forgac et al.
4,640,352 A 2/1987 Vanmeurs et al.
4,671,863 A 6/1987 Tejeda
4,694,907 A 9/1987 Stahl et al.
4,704,514 A 11/1987 Van Egmond et al.
4,705,108 A 11/1987 Little et al.
4,706,751 A 11/1987 Gonduin
4,730,671 A 3/1988 Perkins
4,737,267 A 4/1988 Pao et al.
4,747,642 A 5/1988 Gash et al.
4,754,808 A 7/1988 Harmon et al.
4,776,638 A 10/1988 Hahn
4,779,680 A 10/1988 Sydansk
4,815,790 A 3/1989 Rosar et al.
4,817,711 A 4/1989 Jeambey
4,828,031 A 5/1989 Davis
4,860,544 A 8/1989 Krieg et al.
4,886,118 A 12/1989 Van Meurs et al.
4,923,493 A 5/1990 Valencia et al.
4,926,941 A 5/1990 Glandt et al.
4,928,765 A 5/1990 Nielson
4,929,341 A 5/1990 Thirumalachar et al.
4,954,140 A 9/1990 Kawashima et al.
4,974,425 A 12/1990 Krieg et al.
5,016,709 A 5/1991 Combe et al.
5,036,918 A 8/1991 Jennings et al.
5,050,386 A 9/1991 Krieg et al.
5,051,811 A 9/1991 Williams et al.
5,055,030 A 10/1991 Schirmer
5,055,180 A 10/1991 Klaila
5,082,055 A 1/1992 Hemsath
5,085,276 A 2/1992 Rivas et al.
5,117,908 A 6/1992 Hofmann
5,120,338 A 6/1992 Potts, Jr. et al.
5,217,076 A 6/1993 Masek
5,236,039 A 8/1993 Edelstein
5,255,742 A 10/1993 Mikus
5,275,063 A 1/1994 Steiger et al.
5,277,062 A 1/1994 Blauch et al.
5,297,420 A 3/1994 Gilliland
5,297,626 A 3/1994 Vinegar et al.
5,305,829 A 4/1994 Kumar
5,325,918 A 7/1994 Berryman et al.
5,346,307 A 9/1994 Ramirez et al.
5,372,708 A 12/1994 Gewertz
5,377,756 A 1/1995 Northrop et al.
5,392,854 A 2/1995 Vinegar et al.
5,411,089 A 5/1995 Vinegar et al.
5,416,257 A 5/1995 Peters
5,539,853 A 7/1996 Jamaluddin et al.
5,620,049 A 4/1997 Gipson et al.
5,621,844 A 4/1997 Bridges
5,621,845 A 4/1997 Bridges et al.
5,635,712 A 6/1997 Scott et al.
5,661,977 A 9/1997 Shnell
5,724,805 A 3/1998 Golomb et al.
5,730,550 A 3/1998 Andersland et al.
5,838,634 A 11/1998 Jones et al.
5,844,799 A 12/1998 Joseph et al.
5,868,202 A 2/1999 Hsu
5,899,269 A 5/1999 Wellington et al.
5,905,657 A 5/1999 Celniker
5,907,662 A 5/1999 Buettner
5,938,800 A 8/1999 Verrill et al.
5,956,971 A 9/1999 Cole et al.
6,015,015 A 1/2000 Luft et al.
6,016,867 A 1/2000 Gregoli et al.
6,023,554 A 2/2000 Vinegar et al.
6,055,803 A 5/2000 Mastronarde et al.
6,056,057 A 5/2000 Vinegar et al.
6,079,499 A 6/2000 Mikus et al.
6,112,808 A 9/2000 Isted
6,148,602 A 11/2000 Demetri
6,148,911 A 11/2000 Gipson et al.
6,158,517 A 12/2000 Hsu
6,246,963 B1 6/2001 Cross et al.
6,247,358 B1 6/2001 Dos Santos
6,319,395 B1 11/2001 Kirkbride et al.
6,328,104 B1 12/2001 Graue
6,409,226 B1 6/2002 Slack et al.
6,434,435 B1 8/2002 Tubel et al.
6,434,436 B1 8/2002 Adamy et al.
6,480,790 B1 11/2002 Calvert et al.
6,540,018 B1 4/2003 Vinegar et al.
6,547,956 B1 4/2003 Mukherjee et al.
6,581,684 B2 6/2003 Wellington et al.
6,585,046 B2 7/2003 Neuroth et al.
6,589,303 B1 7/2003 Lokhandwale et al.
6,591,906 B2 7/2003 Wellington et al.
6,607,036 B2 8/2003 Ranson et al.
6,609,735 B1 8/2003 DeLange et al.
6,609,761 B1 8/2003 Ramey et al.
6,659,650 B2 12/2003 Joki et al.
6,659,690 B1 12/2003 Abadi
6,668,922 B2 12/2003 Ziauddin et al.
6,684,644 B2 2/2004 Mittricker et al.
6,684,948 B1 2/2004 Savage
6,708,758 B2 3/2004 de Rouffignac et al.
6,709,573 B2 3/2004 Smith
6,712,136 B2 3/2004 de Rouffignac et al.
6,715,546 B2 4/2004 Vinegar et al.
6,722,429 B2 4/2004 de Rouffignac et al.
6,740,226 B2 5/2004 Mehra et al.
6,742,588 B2 6/2004 Wellington et al.
6,745,831 B2 6/2004 De Rouffignac et al.
6,745,832 B2 6/2004 Wellington et al.
6,745,837 B2 6/2004 Wellington et al.
6,752,210 B2 6/2004 de Rouffignac et al.
6,754,588 B2 6/2004 Cross et al.
6,764,108 B2 7/2004 Ernst et al.
6,782,947 B2 8/2004 de Rouffignac et al.
6,796,139 B2 9/2004 Briley et al.
6,820,689 B2 11/2004 Sarada
6,832,485 B2 12/2004 Surgarmen et al.

(56) References Cited

U.S. PATENT DOCUMENTS 6,854,929 B2 2/2005 Vinegar et al.
6,858,049 B2 2/2005 Mittricker
6,877,555 B2 4/2005 Karanikas et al.
6,880,633 B2 4/2005 Wellington et al.
6,887,369 B2 5/2005 Moulton et al.
6,896,053 B2 5/2005 Berchenko et al.
6,896,707 B2 5/2005 O'Rear et al.
6,913,078 B2 7/2005 Shahin et al.
6,915,850 B2 7/2005 Vinegar et al.
6,918,442 B2 7/2005 Wellington et al.
6,918,443 B2 7/2005 Wellington et al.
6,918,444 B2 7/2005 Passey et al.
6,923,155 B2 8/2005 Gottemoller et al.
6,923,257 B2 8/2005 Wellington et al.
6,923,258 B2 8/2005 Wellington et al.
6,929,067 B2 8/2005 Vinegar et al.
6,932,155 B2 8/2005 Vinegar et al.
6,948,562 B2 9/2005 Wellington et al.
6,951,247 B2 10/2005 De Rouffignac et al.
6,953,087 B2 10/2005 de Rouffignac et al.
6,964,300 B2 11/2005 Vinegar et al.
6,969,123 B2 11/2005 Vinegar et al.
6,988,549 B1 1/2006 Babcock
6,991,032 B2 1/2006 Berchenko et al.
6,991,033 B2 1/2006 Wellington et al.
6,994,160 B2 2/2006 Wellington et al.
6,994,169 B2 2/2006 Zhang et al.
6,997,518 B2 2/2006 Vinegar et al.
7,001,519 B2 2/2006 Linden et al.
7,004,247 B2 2/2006 Cole et al.
7,004,251 B2 2/2006 Ward et al.
7,004,985 B2 2/2006 Wallace et al.
7,011,154 B2 3/2006 Maher et al.
7,013,972 B2 3/2006 Vinegar et al.
7,028,543 B2 4/2006 Hardage et al.
7,032,660 B2 4/2006 Vinegar et al.
7,036,583 B2 5/2006 de Rouffignac et al.
7,040,397 B2 5/2006 de Rouffignac et al.
7,040,399 B2 5/2006 Wellington et al.
7,043,920 B2 5/2006 Viteri et al.
7,048,051 B2 5/2006 McQueen
7,051,807 B2 5/2006 Vinegar et al.
7,051,811 B2 5/2006 de Rouffignac et al.
7,055,600 B2 6/2006 Messier et al.
7,063,145 B2 6/2006 Veenstra et al.
7,066,254 B2 6/2006 Vinegar et al.
7,073,578 B2 7/2006 Vinegar et al.
7,077,198 B2 7/2006 Vinegar et al.
7,077,199 B2 7/2006 Vinegar et al.
7,090,013 B2 8/2006 Wellington
7,093,655 B2 8/2006 Atkinson
7,096,942 B1 8/2006 de Rouffignac et al.
7,096,953 B2 8/2006 de Rouffignac et al.
7,100,994 B2 9/2006 Vinegar et al.
7,103,479 B2 9/2006 Patwardhan et al.
7,104,319 B2 9/2006 Vinegar et al.
7,121,341 B2 10/2006 Vinegar et al.
7,121,342 B2 10/2006 Vinegar et al.
7,124,029 B2 10/2006 Jammes et al.
7,143,572 B2 12/2006 Ooka et al.
7,165,615 B2 1/2007 Vinegar et al.
7,181,380 B2 2/2007 Dusterhoft et al.
7,198,107 B2 4/2007 Maguire
7,219,734 B2 5/2007 Bai et al.
7,225,866 B2 6/2007 Berchenko et al.
7,243,618 B2 7/2007 Gurevich
7,255,727 B2 8/2007 Monereau et al.
7,322,415 B2 1/2008 de St. Remey
7,331,385 B2 2/2008 Symington et al.
7,353,872 B2 4/2008 Sandberg
7,357,180 B2 4/2008 Vinegar et al.
7,405,243 B2 7/2008 Lowe et al.
7,441,603 B2 10/2008 Kaminsky et al.
7,461,691 B2 12/2008 Vinegar et al.
7,472,748 B2 1/2009 Gdanski et al.
7,484,561 B2 2/2009 Bridges
7,516,785 B2 4/2009 Kaminsky
7,516,786 B2 4/2009 Dallas et al.
7,516,787 B2 4/2009 Kaminsky
7,546,873 B2 6/2009 Kim et al.
7,549,470 B2 6/2009 Vinegar et al.
7,556,095 B2 7/2009 Vinegar
7,591,879 B2 9/2009 Sundaram et al.
7,604,054 B2 10/2009 Hocking
7,617,869 B2 11/2009 Carney et al.
7,631,691 B2 12/2009 Symington et al.
7,637,984 B2 12/2009 Adamopoulos
7,644,993 B2 1/2010 Kaminsky et al.
7,647,971 B2 1/2010 Kaminsky
7,647,972 B2 1/2010 Kaminsky
7,654,320 B2 2/2010 Payton
7,669,657 B2 3/2010 Symington et al.
7,743,826 B2 6/2010 Harris et al.
7,798,221 B2 9/2010 Vinegar et al.
7,832,483 B2 11/2010 Trent
7,857,056 B2 12/2010 Kaminsky et al.
7,860,377 B2 12/2010 Vinegar et al.
7,905,288 B2 3/2011 Kinkead
8,087,460 B2 1/2012 Kaminsky
8,127,865 B2 3/2012 Watson et al.
8,176,982 B2 5/2012 Gil et al.
8,356,935 B2 1/2013 Arora et al.
8,540,020 B2 9/2013 Stone et al.
8,596,355 B2 12/2013 Kaminsky et al.
8,608,249 B2 12/2013 Vinegar et al.
8,616,280 B2 12/2013 Kaminsky et al.
8,622,127 B2 1/2014 Kaminsky
8,662,175 B2 3/2014 Karanikas et al.
2001/0049342 A1 12/2001 Passey et al.
2002/0013687 A1 1/2002 Ortoleva
2002/0023751 A1 2/2002 Neuroth et al.
2002/0029882 A1 3/2002 Rouffignac et al.
2002/0049360 A1 4/2002 Wellington et al.
2002/0077515 A1 6/2002 Wellington et al.
2002/0099504 A1 7/2002 Cross et al.
2003/0070808 A1 4/2003 Allison
2003/0080604 A1 5/2003 Vinegar et al.
2003/0085570 A1 5/2003 Ernst et al.
2003/0111223 A1 6/2003 Rouffignac et al.
2003/0131994 A1 7/2003 Vinegar et al.
2003/0131995 A1 7/2003 de Rouffignac et al.
2003/0178195 A1 9/2003 Agee et al.
2003/0183390 A1 10/2003 Veenstra et al.
2003/0192691 A1 10/2003 Vinegar et al.
2003/0196788 A1 10/2003 Vinegar et al.
2003/0196789 A1 10/2003 Wellington
2003/0209348 A1 11/2003 Ward et al.
2003/0213594 A1 11/2003 Wellington et al.
2004/0020642 A1 2/2004 Vinegar et al.
2004/0040715 A1 3/2004 Wellington et al.
2004/0140095 A1 7/2004 Vinegar et al.
2004/0198611 A1 10/2004 Atkinson
2004/0200618 A1 10/2004 Piekenbrock
2004/0211557 A1 10/2004 Cole et al.
2005/0051327 A1 3/2005 Vinegar et al.
2005/0194132 A1 9/2005 Dudley et al.
2005/0211434 A1 9/2005 Gates et al.
2005/0211569 A1 9/2005 Botte et al.
2005/0229491 A1 10/2005 Loffler
2005/0252656 A1 11/2005 Maguire
2005/0252832 A1 11/2005 Doyle et al.
2005/0252833 A1 11/2005 Doyle et al.
2005/0269077 A1 12/2005 Sandberg
2005/0269088 A1 12/2005 Vinegar et al.
2006/0021752 A1 2/2006 de St. Remey
2006/0100837 A1 5/2006 Symington et al.
2006/0102345 A1 5/2006 McCarthy et al.
2006/0106119 A1 5/2006 Guo et al.
2006/0199987 A1 9/2006 Kuechler et al.
2006/0213657 A1 9/2006 Berchenko et al.
2007/0000662 A1 1/2007 Symington et al.
2007/0023186 A1 2/2007 Kaminsky et al.
2007/0045265 A1 3/2007 McKinzie, II
2007/0045267 A1 3/2007 Vinegar et al.

(56) References Cited

U.S. PATENT DOCUMENTS

| | | | |
|---|---|---|---|
| 2007/0084418 | A1 | 4/2007 | Gurevich |
| 2007/0095537 | A1 | 5/2007 | Vinegar |
| 2007/0102359 | A1 | 5/2007 | Lombardi et al. |
| 2007/0131415 | A1 | 6/2007 | Vinegar et al. |
| 2007/0137869 | A1 | 6/2007 | MacDougall et al. |
| 2007/0144732 | A1 | 6/2007 | Kim et al. |
| 2007/0209799 | A1 | 9/2007 | Vinegar et al. |
| 2007/0246994 | A1 | 10/2007 | Kaminsky et al. |
| 2008/0087420 | A1 | 4/2008 | Kaminsky et al. |
| 2008/0087421 | A1 | 4/2008 | Kaminsky |
| 2008/0087422 | A1 | 4/2008 | Kobler et al. |
| 2008/0087426 | A1 | 4/2008 | Kaminsky |
| 2008/0087427 | A1 | 4/2008 | Kaminsky et al. |
| 2008/0087428 | A1 | 4/2008 | Symington et al. |
| 2008/0127632 | A1 | 6/2008 | Finkenrath |
| 2008/0173443 | A1 | 7/2008 | Symington et al. |
| 2008/0185145 | A1 | 8/2008 | Carney et al. |
| 2008/0207970 | A1 | 8/2008 | Meurer et al. |
| 2008/0230219 | A1 | 9/2008 | Kaminsky |
| 2008/0271885 | A1 | 11/2008 | Kaminsky |
| 2008/0283241 | A1 | 11/2008 | Kaminsky et al. |
| 2008/0289819 | A1 | 11/2008 | Kaminsky et al. |
| 2008/0290719 | A1 | 11/2008 | Kaminsky et al. |
| 2008/0314593 | A1 | 12/2008 | Vinegar et al. |
| 2009/0032251 | A1 | 2/2009 | Cavender et al. |
| 2009/0038795 | A1 | 2/2009 | Kaminsky et al. |
| 2009/0050319 | A1 | 2/2009 | Kaminsky et al. |
| 2009/0101346 | A1 | 4/2009 | Vinegar et al. |
| 2009/0101348 | A1 | 4/2009 | Kaminsky |
| 2009/0107679 | A1 | 4/2009 | Kaminsky |
| 2009/0133935 | A1 | 5/2009 | Kinkead |
| 2009/0145598 | A1 | 6/2009 | Symington et al. |
| 2009/0200290 | A1 | 8/2009 | Cardinal et al. |
| 2009/0211754 | A1 | 8/2009 | Verret et al. |
| 2009/0308608 | A1 | 12/2009 | Kaminsky et al. |
| 2010/0038083 | A1 | 2/2010 | Bicerano |
| 2010/0078169 | A1 | 4/2010 | Symington et al. |
| 2010/0089575 | A1 | 4/2010 | Kaminsky et al. |
| 2010/0089585 | A1 | 4/2010 | Kaminsky |
| 2010/0095742 | A1 | 4/2010 | Symington et al. |
| 2010/0101793 | A1 | 4/2010 | Symington et al. |
| 2010/0133143 | A1 | 6/2010 | Roes et al. |
| 2010/0218946 | A1 | 9/2010 | Symington et al. |
| 2010/0276983 | A1 | 11/2010 | Dunn et al. |
| 2010/0282460 | A1 | 11/2010 | Stone et al. |
| 2010/0307744 | A1 | 12/2010 | Cochet et al. |
| 2010/0314108 | A1 | 12/2010 | Crews et al. |
| 2010/0319909 | A1 | 12/2010 | Symington et al. |
| 2011/0000221 | A1 | 1/2011 | Minta et al. |
| 2011/0000671 | A1 | 1/2011 | Hershkowitz et al. |
| 2011/0146981 | A1 | 6/2011 | Diehl |
| 2011/0146982 | A1 | 6/2011 | Kaminsky et al. |
| 2011/0257944 | A1 | 10/2011 | Du et al. |
| 2011/0290490 | A1 | 12/2011 | Kaminsky et al. |
| 2011/0309834 | A1 | 12/2011 | Homan et al. |
| 2012/0012302 | A1 | 1/2012 | Vogel et al. |
| 2012/0267110 | A1 | 10/2012 | Meurer et al. |
| 2012/0325458 | A1 | 12/2012 | El-Rabaa et al. |
| 2013/0043029 | A1 | 2/2013 | Vinegar et al. |
| 2013/0106117 | A1 | 5/2013 | Sites |
| 2013/0112403 | A1 | 5/2013 | Meurer et al. |
| 2013/0277045 | A1 | 10/2013 | Parsche |
| 2013/0292114 | A1 | 11/2013 | Lin et al. |
| 2013/0292177 | A1 | 11/2013 | Meurer et al. |
| 2013/0319662 | A1 | 12/2013 | Alvarez et al. |

FOREIGN PATENT DOCUMENTS

| | | |
|---|---|---|
| CA | 2377467 | 1/2001 |
| CA | 2560223 | 3/2007 |
| EP | 0387846 | 9/1990 |
| FR | 0866212 | 9/1998 |
| GB | 855408 | 11/1960 |
| GB | 1454324 | 11/1976 |
| GB | 1463444 | 2/1977 |
| GB | 1 478 880 | 7/1977 |
| GB | 1501310 | 2/1978 |
| GB | 1559948 | 1/1980 |
| GB | 1595082 | 8/1981 |
| WO | WO 82/01408 | 4/1982 |
| WO | WO 90/06480 | 6/1990 |
| WO | WO 99/67504 | 12/1999 |
| WO | WO 01/78914 | 10/2001 |
| WO | WO 01/81505 | 11/2001 |
| WO | WO 02/085821 | 10/2002 |
| WO | WO 03/035811 | 5/2003 |
| WO | WO 2005/010320 | 2/2005 |
| WO | WO 2005/045192 | 5/2005 |
| WO | WO 2005/091883 | 10/2005 |
| WO | WO 2006/115943 | 11/2006 |
| WO | WO2007/033371 | 3/2007 |
| WO | WO2007/050445 | 5/2007 |
| WO | WO 2007/050479 | 5/2007 |
| WO | WO2010/011402 | 1/2010 |
| WO | WO2010/047859 | 4/2010 |
| WO | WO2011/116148 | 9/2011 |
| WO | WO2011/153339 | 12/2011 |
| WO | WO2014/028834 | 2/2014 |

OTHER PUBLICATIONS

Bridges, J.E., (2007) "Wind Power Energy Storage for in Situ Shale Oil Recovery With Minimal CO2 Emissions", IEEE Transactions on Energy Conversion, vol. 22, No. 1 Mar. 2007, pp. 103-109.

Fox, J. P., et al. (1979) "Partitioning of major, minor, and trace elements during simulated in situ oil shale retorting in a controlled-state retort", Twelfth Oil Shale Symposium Proceedings, Colorado School of Mines, Golden Colorado, Apr. 18-20, 1979.

Garland, T. R., et al. (1979) "Influence of irrigation and weathering reactions on the composition of percolates from retorted oil shale in field lysimeters", Twelfth Oil Shale Symposium Proceedings, Colorado School of Mines, Golden Colorado, Apr. 18-20, 1979, pp. 52-57.

Kilkelly, M. K., et al. (1981), "Field Studies on Paraho Retorted Oil Shale Lysimeters: Leachate, Vegetation, Moisture, Salinity and Runoff, 1977-1980", prepared for Industrial Environmental Research Laboratory, U. S. Environmental Protection Agency, Cincinnati, OH.

Nordin, J. S, et al. (1988), "Groundwater studies at Rio Blanco Oil Shale Company's retort 1 at Tract C-a", DOE/MC/11076-2458.

Poulson, R. E., et al. (1985), "Organic Solute Profile of Water from Rio Blanco Retort 1", DOE/FE/60177-2366.

Rio Blanco Oil Shale Company, (1986), "MIS Retort Abandonment Program" Jun. 1986 Pumpdown Operation.

Robson, S. G. et al., (1981), "Hydrogeochemistry and simulated solute transport, Piceance Basin, northwestern Colorado", U. S. G. S. Prof. Paper 1196.

Stanford University, (2008) "Transformation of Resources to Reserves: Next Generation Heavy-Oil Recovery Techniques", Prepared for U.S. Department of Energy, National Energy Technology Laboratory, DOE Award No. DE-FC26-04NT15526, Mar. 28, 2008.

Taylor, O. J., (1987), "Oil Shale, Water Resources and Valuable Minerals of the Piceance Basin, Colorado: The Challenge and Choices of Development". U. S. Geol. Survey Prof. Paper 1310, pp. 63-76.

Ali, A.H.A, et al, (2003) "Watching Rocks Change—Mechanical Earth Modeling", *Oilfield Review*, pp. 22-39.

Allred, (1964) "Some Characteristic Properties of Colorado Oil Shale Which May Influence In Situ Processing," *Quarterly Colo. School of Mines, 1st Symposium Oil Shale*, v.59. No. 3, pp. 47-75.

Asquith, G., et al., (2004) *Basic Well Log Analysis*, Second Ed., Chapter 1, pp. 1-20.

Ball, J.S., et al. (1949) "Composition of Colorado Shale-Oil Naphtha", *Industrial and Engineering Chemistry*, vol. 41, No. 3 pp. 581-587.

Barnes, A. L. et al. (1968) "Quarterly of the Colorado School of Mines" *Fifth Symposium on Oil Shale*, v. 63(4), Oct. 1968, pp. 827-852.

Bastow, T.P., (1998) Sedimentary Processes Involving Aromatic Hydrocarbons >>. Thesis (PhD in Applied Chemistry) Curtin University of Technology (Australia), December, p. 1-92.

(56) References Cited

OTHER PUBLICATIONS

Baugman, G. L. (1978) *Synthetic Fuels Data Handbook*, Second Edition, Cameron Engineers Inc. pp. 3-145.
Berry, K. L., et al. (1982) "Modified in situ retorting results of two field retorts", Gary, J. H., ed., 15th Oil Shale Symp., CSM, pp. 385-396.
Blanton, T. L. et al, (1999) "Stress Magnitudes from Logs: Effects of Tectonic Strains and Temperature", *SPE Reservoir Eval. & Eng. 2*, vol. 1, February, pp. 62-68.
Boyer, H. E. et al. (1985) "Chapter 16: Heat-Resistant Materials," *Metals Handbook*, American Society for Metals, pp. 6-1 and 16-25.
Brandt, A. R., "*Converting Oil Shale to Liquid Fuels: Energy Inputs and Greenhouse Gas Emissions of the Shell in Situ Conversion Process*," Environ. Sci. Technol. 2008, 42, pp. 7489-7495.
Brandt, H. et al. (1965) "Stimulating Heavy Oil Reservoirs With Downhole Air-Gas Burners," *World Oil*, (Sep. 1965), pp. 91-95.
Bridges, J. E., et al. (1983) "The IITRI in situ fuel recovery process", *J. Microwave Power*, v. 18, pp. 3-14.
Burnham, A. K. et al. (1983) "High-Pressure Pyrolysis of Green River Oil Shale" in Geochemistry and Chemistry of Oil Shales: ACS Symposium Series, pp. 335-351.
Burwell, E. L. et al. (1970) "Shale Oil Recovery by In-Situ Retorting—A Pilot Study" Journal of Petroleum Engr., Dec. 1970, pp. 1520-1524.
Charlier, R. et al, (2002) "Numerical Simulation of the Coupled Behavior of Faults During the Depletion of a High-Pressure/High-Temperature Reservoir", *Society of Petroleum Engineers*, SPE 78199, pp. 1-12.
Chute, F. S., and Vermeulen, F. E., (1988) "Present and potential applications of electromagnetic heating in the in situ recovery of oil", AOSTRA J. Res., v. 4, pp. 19-33.
Chute, F. S. and Vermeulen, F.E., (1989) "Electrical heating of reservoirs", Hepler, L., and Hsi, C., eds., AOSTRA Technical Handbook on Oil Sands, Bitumens, and Heavy Oils, Chapt. 13, pp. 339-376.
Cipolla, C.L., et al. (1994), "Practical Application of in-situ Stress Profiles", *Society of Petroleum Engineers*, SPE 28607, pp. 487-499.
Cook, G. L. et al. (1968) "The Composition of Green River Shale Oils" United Nations Symposium of the Development and Utilization of Oil Shale Resources, pp. 3-23.
Covell, J. R., et al. (1984) "Indirect in situ retorting of oil shale using the TREE process", Gary, J. H., ed., 17th Oil Shale Symposium Proceedings, Colorado School of Mines, pp. 46-58.
Cummins, J. J. et al. (1972) Thermal Degradation of Green River Kerogen at 150 to 350C: Rate of Product Formation, Report of Investigation 7620, *US Bureau of Mines*, 1972, pp. 1-15.
Day, R. L., (1998) "Solution Mining of Colorado Nahcolite, Wyoming State Geological Survey Public Information Circular 40," *Proceedings of the First International Soda Ash Conference*, V.II (Rock Springs, Wyoming, Jun. 10-12) pp. 121-130.
DePriester, C. et al. (1963) "Well Stimulation by Downhole Gas-Air Burner," *Jml. Petro Tech.*, (Dec. 1963), pp. 1297-1302.
Domine, F. et al. (2002) "Up to What Temperature is Petroleum Stable? New Insights from a 5200 Free Radical Reactions Model", *Organic Chemistry*, 33, pp. 1487-1499.
Dougan, P. M. et al. (1981) "BX In Situ Oil Shale Project," *Colorado School of Mines; Fourteenth Oil Shale Symposium Proceedings*, 1981, pp. 118-127.
Dougan, P. M. (1979) "The BX In Situ Oil Shale Project," *Chem. Engr. Progress*, pp. 81-84.
Duncan, D. C., (1967) "Geologic Setting of Oil Shale Deposits and World Prospects," *in Proceedings of the Seventh World Petroleum Congress*, v.3, Elsevier Publishing, pp. 659-667.
Dunks, G. et al. (1983) "Electrochemical Studies of Molten Sodium Carbonate," *Inorg. Chem.*, 22, pp. 2168-2177.
Dusseault, M.B. (1998) "Casing Shear: Causes, Cases, Cures", Society of Petroleum Engineers, SPE 48,864 pp. 337-349.
Dyni, J. R., (1974) "Stratigraphy and Nahcolite Resources of the Saline Facies of the Green River Formation in Northwest Colorado," in D.K. Murray (ed.), *Guidebook to the Energy Resources of the Piceance Creek Basin Colorado, Rocky Mountain Association of Geologists*, Guidebook, pp. 111-122.
Fainberg, V. et al. (1998) "Integrated Oil Shale Processing Into Energy and Chemicals Using Combined-Cycle Technology," *Energy Sources*, v.20.6, pp. 465-481.
Farouq Ali, S. M., (1994), "Redeeming features of in situ combustion", DOE/NIPER *Symposium on In Situ Combustion Practices—Past, Present, and Future Application*, Tulsa, OK, Apr. 21-22, No. ISC 1, p. 3-8.
Fisher, S. T. (1980) "A Comparison of Eleven Processes for Production of Energy from the Solid Fossil Fuels of North America," *SPE* 9098, pp. 1-27.
Fox, J. P, (1980) "Water-related Impacts of In-Situ Oil Shale Processing," *California Univ., Berkeley, Lawrence Berkeley Lab*, Chapters 6-7.
Fredrich, J. T. et al, (1996) "Three-Dimensional Geomechanical Simulation of Reservoir Compaction and Implications for Well Failures in the Belridge Diatomite", *Society of Petroleum Engineers* SPE 36698, pp. 195-210.
Fredrich, J. T. et al, (2000) "Geomechanical Modeling of Reservoir Compaction, Surface Subsidence, and Casing Damage at the Belridge Diatomite Field", *SPE Reservoir Eval. & Eng.3*, vol. 4, August, pp. 348-359.
Fredrich, J. T. et al, (2003) "Stress Perturbations Adjacent to Salt Bodies in the Deepwater Gulf of Mexico", *Society of Petroleum Engineers* SPE 84554, pp. 1-14.
Frederiksen, S. et al, (2000) "A Numerical Dynamic Model for the Norwegian-Danish Basin", *Tectonophysics*, 343, 2001, pp. 165-183.
Freund, H. et al., (1989) "Low-Temperature Pyrolysis of Green River Kerogen", *The American Association of Petroleum Geologists Bulletin*, v. 73, No. 8 (August) pp. 1011-1017.
Gatens III, J. M. et al, (1990) "In-Situ Stress Tests and Acoustic Logs Determine Mechanical Properties and Stress Profiles in the Devonian Shales", *SPE Formation Evaluation* SPE 18523, pp. 248-254.
Garthoffner, E. H., (1998), "Combustion front and burned zone growth in successful California ISC projects", SPE 46244, pp. 1-11.
Greaves, M., et al. (1994) "In situ combustion (ISC) processes: 3D studies of vertical and horizontal wells", *Europe Comm. Heavy Oil Technology in a Wider Europe Symposium*, Berlin, Jun. 7-8, p. 89-112.
Hansen, K. S. et al, (1989) "Earth Stress Measurements in the South Belridge Oil Field, Kern County, California", *SPE Formation Evaluation*, December pp. 541-549.
Hansen, K. S. et al, (1993) "Finite-Element Modeling of Depletion-Induced Reservoir Compaction and Surface Subsidence in the South Belridge Oil Field, California", SPE 26074, pp. 437-452.
Hansen, K. S. et al, (1995) "Modeling of Reservoir Compaction and Surface Subsidence at South Belridge", *SPE Production & Facilities*, August pp. 134-143.
Hardy, M. et al. (2003) "Solution Mining of Nahcolite at the American Soda Project, Piceance Creek, Colorado," *SME Annual Mtg.*, Feb. 24-26, Cincinnati, Ohio, Preprint 03-105.
Hardy, M., et al. (2003) "Solution Mining of Nahcolite at American Soda's Yankee Gulch Project," *Mining Engineering*, Oct. 2003, pp. 23-31.
Henderson, W, et al. (1968) "Thermal Alteration as a Contributory Process to the Genesis of Petroleum", *Nature* vol. 219, pp. 1012-1016.
Hilbert, L. B. et al, (1999) "Field-Scale and Wellbore Modeling of Compaction-Induced Casing Failures", *SPE Drill. & Completion*, 14(2), June pp. 92-101.
Hill, G.R. et al. (1967) "The Characteristics of a Low Temperature In Situ Shale Oil," 4$^{th}$ *Symposium on Oil Shale, Quarterly of the Colorado School of Mines*, v.62(3), pp. 641-656.
Hill, G. R. et al. (1967) "Direct Production of a Low Pour Point High Gravity Shale Oil", *I&EC Product Research and Development*, 6(1), Mar. pp. 52-59.
Holditch, S. A., (1989) "Pretreatment Formation Evaluation", *Recent Advances in Hydraulic Fracturing*, SPE Monograph vol. 12, Chapter 2 (Henry L. Doherty Series), pp. 39-56.
Holmes, A. S. et al. (1982) "Process Improves Acid Gas Separation," *Hydrocarbon Processing*, pp. 131-136.

(56) References Cited

OTHER PUBLICATIONS

Holmes, A. S. et al. (1983) "Pilot Tests Prove Out Cryogenic Acid-Gas/Hydrocarbon Separation Processes," *Oil & Gas Journal*, pp. 85-91.
Humphrey, J. P. (1978) "Energy from in situ processing of Antrim oil shale", *DOE Report FE-2346-29*.
Ingram, L. L. et al. (1983) "Comparative Study of Oil Shales and Shale Oils from the Mahogany Zone, Green River Formation (USA) and Kerosene Creek Seam, Rundle Formation (Australia)," *Chemical Geology*, 38, pp. 185-212.
Ireson, A. T. (1990) "Review of the Soluble Salt Process for In-Situ Recovery of Hydrocarbons from Oil Shale with Emphasis on Leaching and Possible Beneficiation," *23rd Colorado School of Mines Oil Shale Symposium* (Golden, Colorado), 152-161.
Jacobs, H. R. (1983) "Analysis of the Effectiveness of Steam Retorting of Oil Shale", *AIChE Symposium Series—Heat Transfer*—Seattle 1983 pp. 373-382.
Johnson, D. J. (1966) "Decomposition Studies of Oil Shale," *University of Utah*, May 1966.
Katz, D.L. et al. (1978) "*Predicting Phase Behavior of Condensate/Crude-Oil Systems Using Methane Interaction Coefficients, J. Petroleum Technology*", pp. 1649-1655.
Kenter, C. J. et al, (2004) "Geomechanics and 4D: Evaluation of Reservoir Characteristics from Timeshifts in the Overburden", *Gulf Rocks 2004, 6th North America Rock Mechanics Symposium (NARMS): Rock Mechanics Across Borders and Disciplines*, Houston, Texas, Jun. 5-9, ARMA/NARMS 04-627.
Kuo, M. C. T. et al (1979) "Inorganics leaching of spent shale from modified in situ processing," J. H. Gary (ed.) *Twelfth Oil Shale Symposium Proceedings*, Colorado School of Mines, Golden CO., Apr. 18-20, pp. 81-93.
Laughrey, C. D. et al. (2003) "Some Applications of Isotope Geochemistry for Determining Sources of Stray Carbon Dioxide Gas," *Environmental Geosciences*, 10(3), pp. 107-122.
Lekas, M. A. et al. (1991) "Initial evaluation of fracturing oil shale with propellants for in situ retorting—Phase 2", *DOE Report DOE/MC/11076-3064*.
Le Pourhiet, L. et al, (2003) "Initial Crustal Thickness Geometry Controls on the Extension in a Back Arc Domain: Case of the Gulf of Corinth", *Tectonics*, vol. 22, No. 4, pp. 6-1-6-14.
Lundquist, L. (1951) "Refining of Swedish Shale Oil", *Oil Shale Cannel Coal Conference*, vol./Issue: 2, pp. 621-627.
Marotta, A. M. et al, (2003) "Numerical Models of Tectonic Deformation at the Baltica-Avalonia Transition Zone During the Paleocene Phase of Inversion", *Tectonophysics*, 373, pp. 25-37.
Miknis, F.P, et al (1985) "Isothermal Decomposition of Colorado Oil Shale", DOE/FE/60177-2288 (DE87009043) May 1985.
Mohammed, Y.A., et al (2001) "A Mathematical Algorithm for Modeling Geomechanical Rock Properties of the Khuff and PreKhuff Reservoirs in Ghawar Field", *Society of Petroleum Engineers* SPE 68194, pp. 1-8.
Molenaar, M. M. et al, (2004) "Applying Geo-Mechanics and 4D: '4D In-Situ Stress' as a Complementary Tool for Optimizing Field Management", *Gulf Rocks 2004, 6th North America Rock Mechanics Symposium (NARMS): Rock Mechanics Across Borders and Disciplines*, Houston, Texas, Jun. 5-9, ARMA/NARMS 04-639, pp. 1-7.
Moschovidis, Z. (1989) "Interwell Communication by Concurrent Fracturing—a New Stimulation Technique", *Journ. of Canadian Petro. Tech.* 28(5), pp. 42-48.
Motzfeldt, K. (1954) "The Thermal Decomposition of Sodium Carbonate by the Effusion Method," *Jml. Phys. Chem.*, v. LIX, pp. 139-147.
Mut, Stephen (2005) "The Potential of Oil Shale," *Shell Oil Presentation at National Academies, Trends in Oil Supply Demand*, in Washington, DC, Oct. 20-21, 2005, 11 pages.
Needham, et al (1976) "Oil Yield and Quality from Simulated In-Situ Retorting of Green River Oil Shale", Society of Petroleum Engineers of American Institute of Mining, Metallurgical and Petroleum Engineers, Inc. SPE 6069.
Newkirk, A. E. et al. (1958) "Drying and Decomposition of Sodium Carbonate," *Anal. Chem.*, 30(5), pp. 982-984.
Nielsen, K. R., (1995) "Colorado Nahcolite: A Low Cost Source of Sodium Chemicals," *7th Annual Canadian Conference on Markets for Industrial Minerals*, (Vancouver, Canada, Oct. 17-18) pp. 1-9.
Nottenburg, R.N. et al. (1979) "Temperature and stress dependence of electrical and mechanical properties of Green River oil shale," *Fuel*, 58, pp. 144-148.
Nowacki, P. (ed.), (1981) *Oil Shale Technical Handbook*, Noyes Data Corp. pp. 4-23, 80-83 & 161-183.
Pattillo, P. D. et al, (1998) "Reservoir Compaction and Seafloor Subsidence at Valhall", SPE 47274, 1998, pp. 377-386.
Pattillo, P. D. et al, (2002) "Analysis of Horizontal Casing Integrity in the Valhall Field", SPE 78204, pp. 1-10.
Persoff, P. et al. (1979) "Control strategies for abandoned in situ oil shale retorts," J. H. Gary (ed.), *12th Oil Shale Symposium Proceedings*, Colorado School of Mines, Golden, CO., Apr. 18-20, pp. 72-80.
Peters, G., (1990) "The Beneficiation of Oil Shale by the Solution Mining of Nahcolite," *23rd Colorado School of Mines Oil Shale Symposium* (Golden, CO) pp. 142-151.
Plischke, B., (1994) "Finite Element Analysis of Compaction and Subsidence—Experience Gained from Several Chalk Fields", *Society of Petroleum Engineers*, SPE 28129, 1994, pp. 795-802.
Prats, M. et al. (1975) "The Thermal Conductivity and Diffusivity of Green River Oil Shales", *Journal of Petroleum Technology*, pp. 97-106, Jan. 1975.
Prats, M., et al. (1977) "Soluble-Salt Processes for In-Situ Recovery of Hydrocarbons from Oil Shale," *Journal of Petrol. Technol.*, pp. 1078-1088.
Rajeshwar, K. et al. (1979) "Review: Thermophysical Properties of Oil Shales", *Journal of Materials Science*, v.14, pp. 2025-2052.
Ramey, M. et al. (2004) "The History and Performance of Vertical Well Solution Mining of Nahcolite ($NaHCO_3$) in the Piceance Basin, Northwestern, Colorado, USA," *Solution Mining Research Institute: Fall 2004 Technical Meeting* (Berlin, Germany).
Reade Advanced Materials; 2006 About.com Electrical resistivity of materials. [Retrieved on Oct. 15, 2009] Retrieved from internet: URL:http://www.reade.com/Particle%5FBriefings/elec%5Fres.html. Entire Document.
Riva, D. et al. (1998) "Suncor down under: the Stuart Oil Shale Project", Annual Meeting of the *Canadian Inst. of Mining, Metallurgy, and Petroleum*, Montreal, May 3-7.
Rupprecht, R. (1979) "Application of the Ground-Freezing Method to Penetrate a Sequence of Water-Bearing and Dry Formations—Three Construction Cases," *Engineering Geology*, 13, pp. 541-546.
Ruzicka, D.J. et al. (1987) "Modified Method Measures Bromine Number of Heavy Fuel Oils", *Oil & Gas Journal*, 85(31), Aug. 3, pp. 48-50.
Salamonsson, G. (1951) "The Ljungstrom In Situ Method for Shale-Oil Recovery," *2nd Oil Shale and Cannel Coal Conference*, 2, Glasgow, Scotland, Inst. of Petrol., London, pp. 260-280.
Sahu, D. et al. (1988) "Effect of Benzene and Thiophene on Rate of Coke Formation During Naphtha Pyrolysis", *Canadian Journ. of Chem. Eng.*, 66, Oct. pp. 808-816.
Sandberg, C. R. et al. (1962) "In-Situ Recovery of Oil from Oil Shale—A Review and Summary of Field and Laboratory Studies," RR62.039FR, Nov. 1962.
Sierra, R. et al. (2001) "Promising Progress in Field Application of Reservoir Electrical Heating Methods," *SPE 69709*, SPE Int'l Thermal Operations and Heavy Oil Symposium, Venezuela, Mar. 2001, 17 pages.
Siskin, M. et al. (1995) "Detailed Structural Characterization of the Organic Material in Rundel Ramsay Crossing and Green River Oil Shales," *Kluwer Academic Publishers*, pp. 143-158.
Smart, K. J. et al, (2004) "Integrated Structural Analysis and Geomechanical Modeling: an Aid to Reservoir Exploration and Development", *Gulf Rocks 2004, 6th North America Rock Mechanics Symposium (NARMS): Rock Mechanics Across Borders and Disciplines*, Houston, Texas, Jun. 5-9, ARMA/NARMS 04-470.
Smith, F. M. (1966) "A Down-hole Burner—Versatile Tool for Well Heating," *25th Tech. Conf. on Petroleum Production*, Pennsylvania State Univ., pp. 275-285.

(56) References Cited

OTHER PUBLICATIONS

Sresty, G. C.; et al. (1982) "Kinetics of Low-Temperature Pyrolysis of Oil Shale by the IITRI RF Process," *Colorado School of Mines; Fifteenth Oil Shale Symposium Proceedings*, Aug. 1982, pp. 411-423.

Stevens, A. L., and Zahradnik, R. L. (1983) "Results from the simultaneous processing of modified in situ retorts 7& 8", Gary, J. H., ed., *16th Oil Shale Symp.*, CSM, p. 267-280.

Stoss, K. et al. (1979) "Uses and Limitations of Ground Freezing With Liquid Nitrogen," *Engineering Geology*, 13, pp. 485-494.

Symington, W.A., et al (2006) ExxonMobil's electrofrac process for in situ oil shale conversion 26th Oil Shale Symposium, Colorado School of Mines.

Syunyaev, Z.I. et al. (1965) "Change in the Resistivity of Petroleum Coke on Calcination," Chemistry and Technology of Fuels and Oils, 1(4), pp. 292-295.

Templeton, C. C. (1978) "Pressure-Temperature Relationship for Decomposition of Sodium Bicarbonate from 200 to 600° F.," *J. of Chem. and Eng. Data*, 23(1), pp. 7-8.

Thomas, A. M. (1963) "Thermal Decomposition of Sodium Carbonate Solutions," *J. of Chem. and Eng. Data*, 8(1), pp. 51-54.

Thomas, G. W. (1964) "A Simplified Model of Conduction Heating in Systems of Limited Permeability," *Soc.Pet. Engineering Journal*, Dec. 1964, pp. 335-344.

Thomas, G. W. (1966) "Some Effects of Overburden Pressure on Oil Shale During Underground Retorting," *Society of Petroleum Engineers Journal*, pp. 1-8, Mar. 1966.

Tihen, S. S. et al. (1967) "Thermal Conductivity and Thermal Diffusivity of Green River Oil Shale," *Thermal Conductivity: Proceedings of the Seventh Conference* (Nov. 13-16, 1967), *NBS Special Publication* 302, pp. 529-535, 1968.

Tisot, P. R. et al. (1970) "Structural Response of Rich Green River Oil Shales to Heat and Stress and Its Relationship to Induced Permeability," *Journal of Chemical Engineering Data*, v. 15(3), pp. 425-434.

Tisot, P. R. et al. (1971) "Structural Deformation of Green River Oil Shale as It Relates to In Situ Retorting," *US Bureau of Mines Report of Investigations* 7576, 1971.

Tisot, P. R. (1975) "Structural Response of Propped Fractures in Green River Oil Shale as It Relates to Underground Retorting," *US Bureau of Mines Report of Investigations 8021*.

Tissot, B. P., and Welte, D. H. (1984) *Petroleum Formation and Occurrence*, New York, Springer-Verlag, p. 160-174, 175-198 and 254-266.

Tissot, B. P., and Welte, D. H. (1984) *Petroleum Formation and Occurrence*, New York, Springer-Verlag, p. 267-289 and 470-492.

Turta, A., (1994), "In situ combustion—from pilot to commercial application", *DOE/NIPER Symposium on In Situ Combustion Practices—Past, Present, and Future Application*, Tulsa, OK, Apr. 21-22, No. ISC 3, p. 15-39.

Tyner, C. E. et al. (1982) "Sandia/Geokinetics Retort 23: a horizontal in situ retorting experiment", Gary, J. H., ed., *15th Oil Shale Symp.*, CSM, p. 370-384.

Tzanco, E. T., et al. (1990), "Laboratory Combustion Behavior of Countess B Light Oil", *Petroleum Soc. of CIM and SPE*, Calgary, Jun. 10-13, No. CIM/SPE 90-63, p. 63.1-63.16.

Veatch, Jr. R.W. and Martinez, S.J., et al. (1990) "Hydraulic Fracturing: Reprint Series No. 28", *Soc. of Petroleum Engineers* SPE 14085, Part I, Overview.

Warpinski, N.R., (1989) "Elastic and Viscoelastic Calculations of Stresses in Sedimentary Basins", *SPE Formation Evaluation*, vol. 4, pp. 522-530.

Yen, T. F. et al. (1976) *Oil Shale*, Amsterdam, Elsevier, p. 216-267.

Yoon, E. et al. (1996) "High-Temperature Stabilizers for Jet Fuels and Similar Hydrocarbon Mixtures. 1. Comparative Studies of Hydrogen Donors", *Energy & Fuels*, 10, pp. 806-811.

Oil & Gas Journal, 1998, "Aussie oil shale project moves to Stage 2", Oct. 26, p. 42.

"Encyclopedia of Chemical Technology" (4th ed.), *Alkali and Chlorine Products*, pp. 1025-1039 (1998).

Vermeulen, F.E., et al. (1983) "Electromagnetic Techniques in the In-Situ Recovery of Heavy Oils", *Journal of Microwave Power*, 18(1) pp. 15-29.

SYSTEMS AND METHODS OF DETECTING AN INTERSECTION BETWEEN A WELLBORE AND A SUBTERRANEAN STRUCTURE THAT INCLUDES A MARKER MATERIAL

CROSS-REFERENCE TO RELATED APPLICATION

This application claims the priority benefit of U.S. Provisional Patent Application 61/642,811 filed May 4, 2012 entitled Systems and Methods Of Detecting an Intersection Between A Wellbore and A Subterranean Structure That Includes A Marker Material, the entirety of which is incorporated by reference herein.

FIELD OF THE DISCLOSURE

The present disclosure is directed generally to systems and methods of detecting, or determining, an intersection between a wellbore and a subterranean structure that includes a marker material.

BACKGROUND OF THE DISCLOSURE

Accurate detection of an intersection between a subterranean structure and a wellbore that is configured to intersect the subterranean structure may improve, or enhance, well drilling capabilities. These enhanced well drilling capabilities may decrease well drilling costs, decrease costs associated with the formation and/or development of the subterranean structure, and/or provide for the development of improved well drilling technologies.

As an illustrative, non-exclusive example, hydraulic fracturing may be utilized to form a relatively large, relatively planar subterranean structure, such as a hydraulic fracture, within a subterranean formation. This hydraulic fracture, or fracture, may include planar dimensions that are on the order of tens to hundreds of meters; however, a thickness of the fracture may only be a few millimeters.

Subsequent to formation of the fracture, it may be desirable to provide a supplemental material thereto. This may include focused delivery of the supplemental material to a target, or desired, region of the fracture to provide for accurate placement of the supplemental material and/or to decrease a potential for waste of the supplemental material. Furthermore, it may be desirable to provide the supplemental material to a portion, or region, of the fracture that is spaced apart from a stimulation well that was utilized to create the fracture by drilling another wellbore that intersects the subterranean structure. However, the reduced thickness of the fracture in such spaced-apart portions, or regions, increases the difficulty of accurately detecting intersection of the additional wellbore with the fracture. Thus, there exists a need for systems and methods for accurate detection of the intersection between such a wellbore with the subterranean fracture and/or subterranean structure.

SUMMARY OF THE DISCLOSURE

Systems and methods of detecting an intersection between a wellbore and a subterranean structure that includes a marker material. These systems and methods include drilling the wellbore and determining that the wellbore has intersected a portion of the subterranean structure that includes the marker material by detecting the marker material. The systems and methods also may include distributing the marker material within the subterranean structure, aligning the marker material within the subterranean structure, determining one or more characteristics of the marker material, ceasing the drilling, repeating the method, and/or producing a hydrocarbon from the subterranean structure. The systems and methods further may include forming an electrical connection between an electric current source and a granular resistive heater that forms a portion of the subterranean structure, forming the granular resistive heater, and/or forming the subterranean structure.

In some embodiments, the drilling may include controlling the drilling based, at least in part, on the detecting. In some embodiments, the controlling may include a control system. In some embodiments, the detecting may include detecting any suitable characteristic of the marker material, detecting a proximity of the marker material to a detector, and/or remotely detecting the marker material with the detector. In some embodiments, the distributing may include flowing the marker material into the subterranean structure.

In some embodiments, forming the electrical connection between the electric current source and the granular resistive heater may include detecting an intersection between an electrode well and the granular resistive heater, providing a supplemental material through the electrode well and to a portion of the granular resistive heater, forming an electrical connection between the supplemental material and the portion of the granular resistive heater, and/or forming an electrical connection between the supplemental material and an electrical conduit that is configured to convey the electric current between the electric current source and the granular resistive heater. In some embodiments, forming the granular resistive heater may include creating a fracture within a subterranean formation, supplying a proppant that includes a granular resistive heating material to the fracture, and/or forming the electrical connection between the granular resistive heater and the electric current source.

DETAILED DESCRIPTION AND BEST MODE OF THE DISCLOSURE

Figure 1:
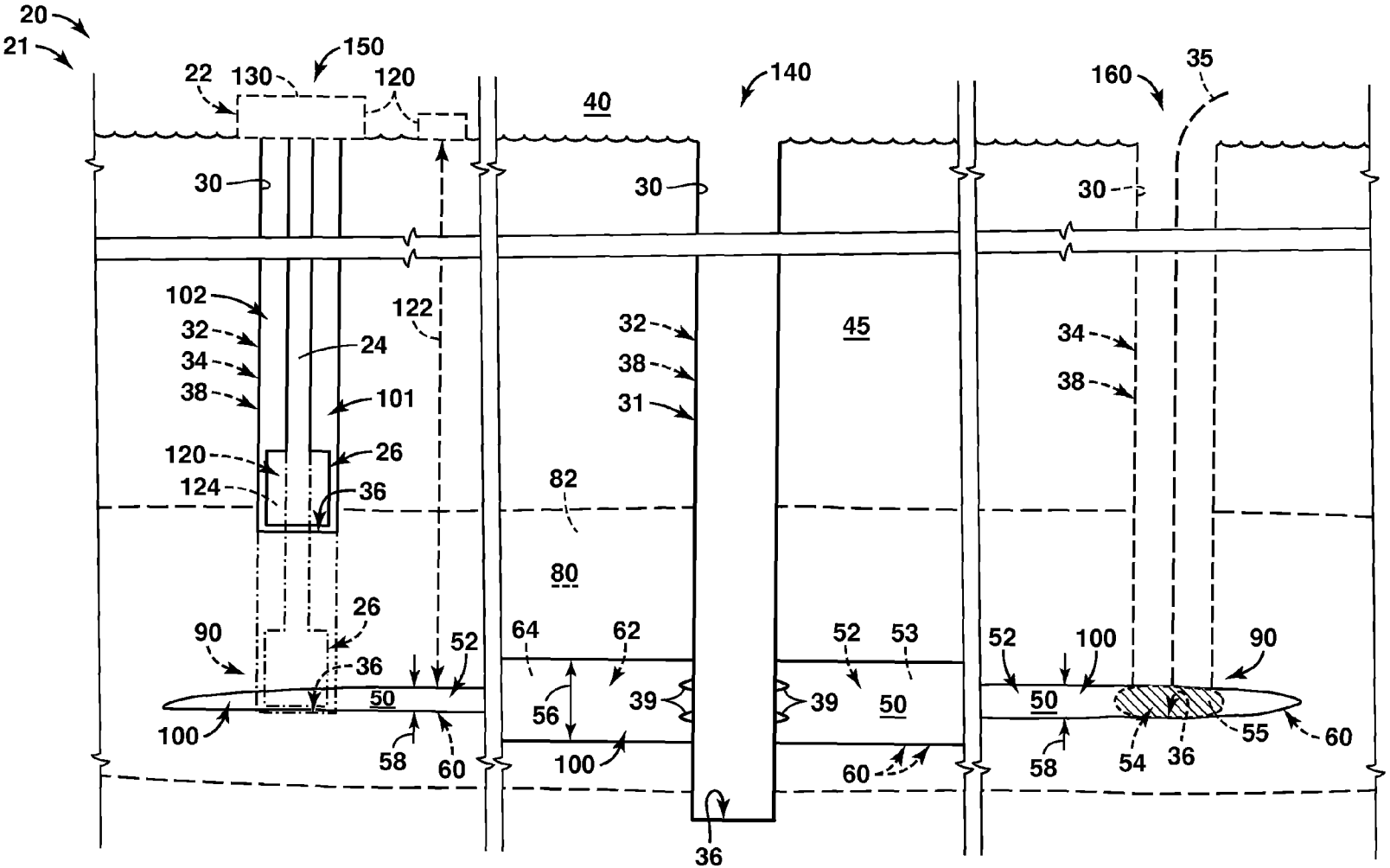
FIG. 1 is a schematic cross-sectional view of illustrative, non-exclusive examples of a drilling operation that may utilize the systems and methods according to the present disclosure.

FIG. 1 is a schematic cross-sectional view of illustrative, non-exclusive examples of a drilling operation 20 and/or a hydrocarbon production operation 21 that may utilize the systems and methods according to the present disclosure. In FIG. 1, a plurality of wellbores 30 are configured to provide mechanical, electrical, and/or fluid communication between a surface region 40 and a subterranean structure 50, such as a granular resistive heater 52, that is formed within a subterranean region 45 and that includes a marker material 100. Wellbores 30 additionally or alternatively may be referred to as, and/or as forming a portion of, wells 30.

As illustrative, non-exclusive examples, wellbores 30 may include, be utilized as, and/or be a stimulation well 32 that is configured to provide a stimulant fluid to a subterranean formation 80 and/or to subterranean structure 50 thereof, an electrode well 34 that is configured to provide an electrical connection between an electric current source and the subterranean structure, and/or a hydrocarbon well 38 that is configured to produce hydrocarbons 82 from subterranean formation 80 and/or subterranean structure 50 thereof. As an illustrative, non-exclusive example, subterranean formation 80 may include any suitable oil shale, tar sands, and/or organic-rich rock formation that may contain and/or include one or more hydrocarbons 82, such as kerogen and/or bitumen, and wellbores 30 may be utilized to stimulate the subterranean formation and/or to produce hydrocarbons 82 from the subterranean formation.

As used herein, the phrase "subterranean structure" may refer to any suitable structure that is present within subterranean region 45 and which includes marker material 100 distributed therein. It is within the scope of the present disclosure that at least a portion of subterranean structure 50 may be constructed, may include material deposited from surface region 40 via a wellbore 30, and/or may be man-made. Additionally or alternatively, it is also within the scope of the present disclosure that at least a portion of subterranean structure 50 may be naturally occurring. Whether the subterranean structure is man-made or naturally occurring, marker material 100 is not naturally occurring within the subterranean structure and/or is not naturally occurring within the subterranean structure at the concentrations that are utilized herein. Instead, the marker material is purposefully placed, directed, localized, situated, spread, dispersed, broadcast, dispensed, and/or distributed within the subterranean structure as part of, and/or in conjunction with, the systems and methods that are disclosed herein.

As shown in FIG. 1 at 140, a well 30 in the form of a stimulation well 32 may be utilized to provide a stimulation fluid through perforations 39 in a casing 31 thereof and into subterranean formation 80. The stimulation fluid may create one or more fractures 60 within the subterranean formation. Fracture(s) 60 may form a portion of and/or define an outer boundary of subterranean structure 50.

Subsequent to formation of fractures 60, and as discussed in more detail herein, a proppant material 62, such as which may be and/or include a granular resistive heating material 53, may be provided to the fracture to maintain fracture 60 in an open configuration; and cement 64 may be utilized to hold, maintain, and/or otherwise affix at least a portion of proppant material 62 in place such that the proppant material may resist displacement from fracture 60 due to fluid flow therethrough and/or pressure differentials thereacross. The granular resistive heater may be in electrical communication with an electric current source, which may provide electric current to the granular resistive heater to heat subterranean formation 80. To provide for supply of electric current to, and withdrawal of electric current from, the granular resistive heater, it may be desirable to drill at least one, and often a plurality of electrode wells 34, each of which may provide an electrical connection between the granular resistive heater and the electric current source. In order to improve the performance of the granular resistive heater and/or to reduce the costs associated with forming the granular resistive heater, it may be desirable to provide for accurate determination of an intersection point 90 between electrode well 34 and granular resistive heater 52. Intersection 90 may additionally or alternatively be referred to herein as an intersection region and/or intersection point.

Additionally or alternatively, it also may be desirable to obtain a measure of a thickness 58 of the granular resistive heater in a region that is proximal to the electrode well, to compare such a thickness 58 to a thickness 56 of the granular resistive heater in a region that is proximal to the stimulation well, and/or to drill electrode wells 34 such that thickness 58 at intersection point 90 is within a target, or desired, thickness range. Illustrative, non-exclusive examples of stimulation well-proximal thickness 56 according to the present disclosure include thicknesses of at least 3 mm, at least 4 mm, at least 5 mm, at least 6 mm, at least 7 mm, or at least 8 mm, as well as thicknesses of less than 12 mm, less than 11 mm, less than 10 mm, less than 9 mm, less than 8 mm, less than 7 mm, less than 6 mm, or less than 5 mm. Illustrative, non-exclusive examples of electrode well-proximal thickness 58 according to the present disclosure include thicknesses of at least 0.25 mm, at least 0.5 mm, at least 0.75 mm, at least 1 mm, at least 1.25 mm, at least 1.5 mm, at least 1.75 mm, at least 2 mm, at least 2.25 mm, or at least 2.5 mm, and additionally or alternatively include thicknesses of less than 5 mm, less than 4 mm, less than 3.5 mm, less than 3 mm, less than 2.75 mm, less than 2.5 mm, less than 2.25 mm, less than 2 mm, less than 1.75 mm, less than 1.5 mm, less than 1.25 mm, or less than 1 mm. The systems and methods disclosed herein are not limited to the above illustrative, non-exclusive examples, and it is within the scope of the present disclosure that the systems and methods may be used with regions that have thicknesses that are within and/or outside of these non-exclusive examples.

The granular resistive heater 52 may include any suitable size and/or dimensions. As illustrative, non-exclusive examples, a length (or other maximum dimension) of the granular resistive heater may be at least 50, at least 60, at least 70, at least 80, at least 90, at least 100, at least 110, at least 125, or at least 150 meters. Additionally or alternatively, a width (or other transverse dimension relative to the length) of the granular resistive heater may be at least 25, at least 30, at least 35, at least 40, at least 45, at least 50, at least 55, at least 60, or at least 70 meters. The preceding discussion of the length and width of the granular resistive heater may additionally or alternatively be referred to as the height and width, width and height, and/or maximum and minimum transverse dimensions of the granular resistive heater. Similarly, the granular resistive heater may include any suitable shape, an illustrative, non-exclusive example of which includes a planar, or at least substantially planar, shape. Illustrative, non-exclusive examples of granular resistive heaters, stimulation wells, and/or electrode wells that may be utilized with the system and methods according to the present disclosure are disclosed in U.S. Patent Application Ser. No. 61/555,940, the complete disclosure of which is hereby incorporated by reference.

During formation of wellbores 30, and as illustrated at 150 in FIG. 1, a drilling rig 22 including a drill string 24 may be utilized to create wellbore 30 using a drill bit 26. Drill bit 26 may remove cuttings 102 from a terminal end 36, which also may be referred to herein as terminal depth 36, of wellbore 30, and the cuttings may be conveyed through wellbore 30 to surface region 40 in a drilling fluid 101. As shown in solid lines in FIG. 1, wellbore 30 may have, or include, a current terminal depth 36 at a given time during formation of the wellbore. Subsequently, and as shown in dash-dot lines in FIG. 1, terminal depth 36 of wellbore 30 may be increased by drilling operation 20 to a future terminal depth that is greater than the current terminal depth.

The systems and methods disclosed herein may be configured to control the operation of drilling rig 22, drill string 24, and/or drill bit 26, such as to control terminal depth 36 of wellbore 30 and/or to detect an intersection, or intersection point, of wellbore 30 with subterranean structure 50. As an illustrative, non-exclusive example, drill string 24 may include a detector 120 that is configured to detect the intersection of the wellbore with the subterranean structure. As an illustrative, non-exclusive example, detector 120 may be configured to detect marker material 100 and/or to generate an intersection signal responsive to detection of the marker material.

As another illustrative, non-exclusive example, and as also shown in FIG. 1, detector 120 may be located within surface region 40, in communication with drilling rig 22, and/or associated with drilling rig 22. As an illustrative, non-exclusive example, detector 120 may be configured to (1) detect the presence of marker material 100 within drilling fluid 101 and/or cuttings 102 that flow to surface region 40 from wellbore 30 and to (2) generate the intersection signal responsive thereto. As another illustrative, non-exclusive example, detector 120 may be configured to detect a separation distance 122 between the detector and the marker material, between surface region 40 and the marker material, between drilling rig 22 and the marker material, and/or between drill bit 26 and the marker material.

As shown in dashed lines in FIG. 1, drilling operation 20 and/or hydrocarbon production operation 21 may include a control system 130 that is configured to control the operation of drilling rig 22 and/or drill string 24 thereof. As an illustrative, non-exclusive example, and when detector 120 is configured to detect the presence of marker material 100, control system 130 may be configured to cease drilling wellbore 30 responsive to receipt of the intersection signal. As another illustrative, non-exclusive example, and when detector 120 is configured to detect separation distance 122, control system 130 may be configured to cease drilling wellbore 30 and/or to generate the intersection signal responsive to detecting that terminal depth 36 of wellbore 30 is equal to, or within a threshold distance of, separation distance 122.

Control system 130 may include any suitable structure that is configured to control the operation of drilling rig 22 and/or drill string 24 thereof. As illustrative, non-exclusive examples, the control system may include and/or be an electronic controller, an automated controller, and/or a manually actuated controller. When control system 130 includes an electronic and/or automated controller, the control system may be configured to generate the intersection signal, and/or to receive the intersection signal from, detector 120 and automatically control the operation of drilling rig 22 responsive thereto. Additionally or alternatively, and when control system 130 includes a manually actuated controller, the control system may include an indicator that may indicate to a user that wellbore 30 has intersected subterranean structure 50, and the user may control the operation of the drilling rig based thereon.

Detector 120 may include any suitable structure that is configured to detect the presence of marker material 100 and/or the separation distance between the detector and the marker material. As an illustrative, non-exclusive example, and when the detector is configured to detect marker material 100 that is proximal to and/or in contact with the detector, the detector may include a logging-while-drilling transducer 124 that is located on the drill string. It is within the scope of the present disclosure that the logging-while-drilling transducer may be located upon and/or otherwise associated with or coupled to any suitable portion of the drill string. As illustrative, non-exclusive examples, the logging-while-drilling transducer may be located within a threshold distance of drill bit 26 and/or a terminal end of the drill string. Illustrative, non-exclusive examples of threshold distances according to the present disclosure include threshold distances of less than 1 meter, less than 0.75 meters, less than 0.5 meters, less than 0.25 meters, or less than 0.1 meters. As another illustrative, non-exclusive example, and when detector 120 is configured to detect marker material 100 that is proximal to and/or in contact with the detector, the detector may be configured to detect the presence and/or concentration of marker material 100 within cuttings 102 and/or drilling fluid 101.

As yet another illustrative, non-exclusive example, and when detector 120 is configured to detect separation distance 122 and/or to remotely detect the marker material, the detector may include any suitable receiver that is configured to detect any suitable signal emitting or otherwise emanating or propagating from the marker material. Additionally or alternatively, detector 120 and/or control system 130 also may include any suitable transmitter that is configured to provide an excitation signal to marker material 100, with the excitation signal causing the emission of the signal from the marker material. As illustrative, non-exclusive examples, detector 120 may be configured to provide a signal electric field, a signal magnetic field, and/or signal electromagnetic radiation to the marker material over the separation distance and to receive a resultant electric field, a resultant magnetic field, and/or resultant electromagnetic radiation from the marker material over the separation distance. Illustrative, non-exclusive examples of separation distances according to the present disclosure include separation distances of greater than 1 meter, greater than 5 meters, greater than 10 meters, greater than 25 meters, greater than 50 meters, greater than 100 meters, greater than 250 meters, greater than 500 meters, or greater than 1,000 meters, as well as separation distances of less than 10,000 meters, less than 7,500 meters, less than 5,000 meters, less than 2,500 meters, less than 1,000 meters, less than 750 meters, less than 500 meters, or less than 250 meters.

Marker material may be present within the subterranean structure at any suitable concentration and/or any suitable concentration distribution. As illustrative, non-exclusive examples, the concentration of the marker material within the subterranean structure may be less than 5 volume %, less than 3 volume %, less than 2 volume %, less than 1 volume %, less than 0.75 volume %, less than 0.5 volume %, less than 0.25 volume %, less than 0.1 volume %, less than 0.05 volume %, less than 0.01 volume %, or less than 0.005 volume %. Additionally or alternatively, the concentration of the marker material within the subterranean structure may be greater than 0.001 volume %, greater than 0.005 volume %, greater than 0.01 volume %, greater than 0.05 volume %, greater than 0.1 volume %, greater than 0.25 volume %, or greater than 0.5 volume %.

Figure 3:
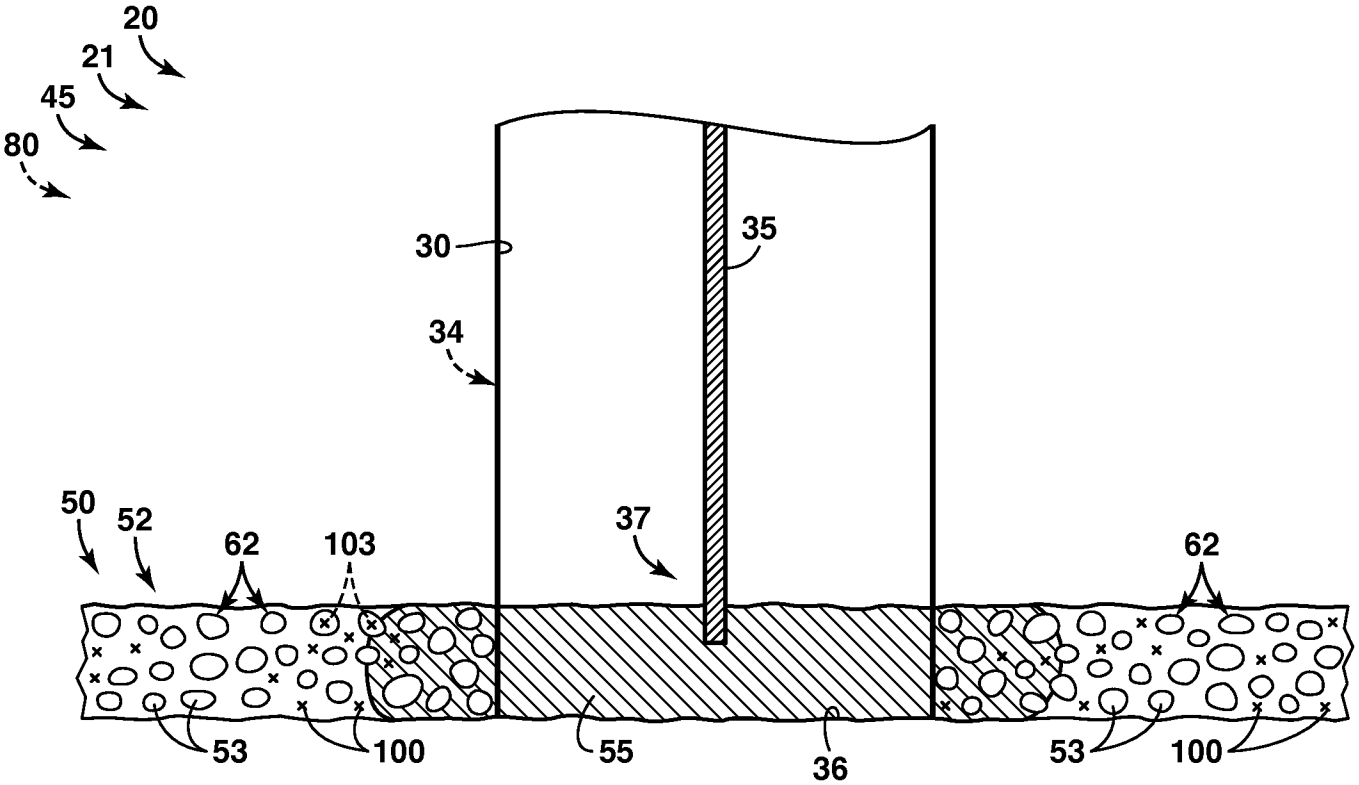
FIG. 3 is a schematic cross-sectional detail showing illustrative, non-exclusive examples of an electrical connection according to the present disclosure between a subterranean structure that includes a granular resistive heater and an electrical conduit.

As discussed in more detail herein with reference to the schematic illustration shown in FIG. 3, it is within the scope of the present disclosure that marker material 100 may include a plurality of discrete marker bodies that may include any suitable shape and/or distribution of shapes. As illustrative, non-exclusive examples, at least a portion of the plurality of discrete marker material particles may include a spherical structure, an at least substantially spherical structure, and/or an elongate structure. When the marker material includes a plurality of discrete marker bodies, the detector may be configured to generate the intersection signal responsive to detecting a portion of the plurality of discrete marker bodies.

Marker material 100, and/or dimensions and/or flow characteristic thereof, may be selected based, at least in part, on a target, or desired, distribution of the plurality of discrete marker bodies within the subterranean structure, a density of a fluid that may be present within the subterranean structure, a viscosity of a fluid that may be present within the subterranean structure, and/or an average pore size within the subterranean structure. As illustrative, non-exclusive examples, a shape, volume, density, and/or settling velocity of the plurality of discrete marker material particles may be selected based, at least in part, on the desired distribution. As another illustrative, non-exclusive example, the plurality of discrete marker material particles may be selected such that an average characteristic dimension, such as an average diameter, equivalent diameter, and/or length, may be within a desired range of values. Illustrative, non-exclusive examples of such average characteristic dimensions include average characteristic dimensions that are less than 250, less than 200, less than 150, less than 125, less than 100, less than 75, less than 50, less than 25, less than 10, less than 5, less than 2, less than 1, less than 0.5, or even less than or equal to 0.1 micrometers, as well as average characteristic dimensions that are greater than 0.05, greater than 0.1, greater than 1, greater than 2, greater than 5, greater than 10, greater than 20, greater than 25, or greater than 50 micrometers.

Figure 2:
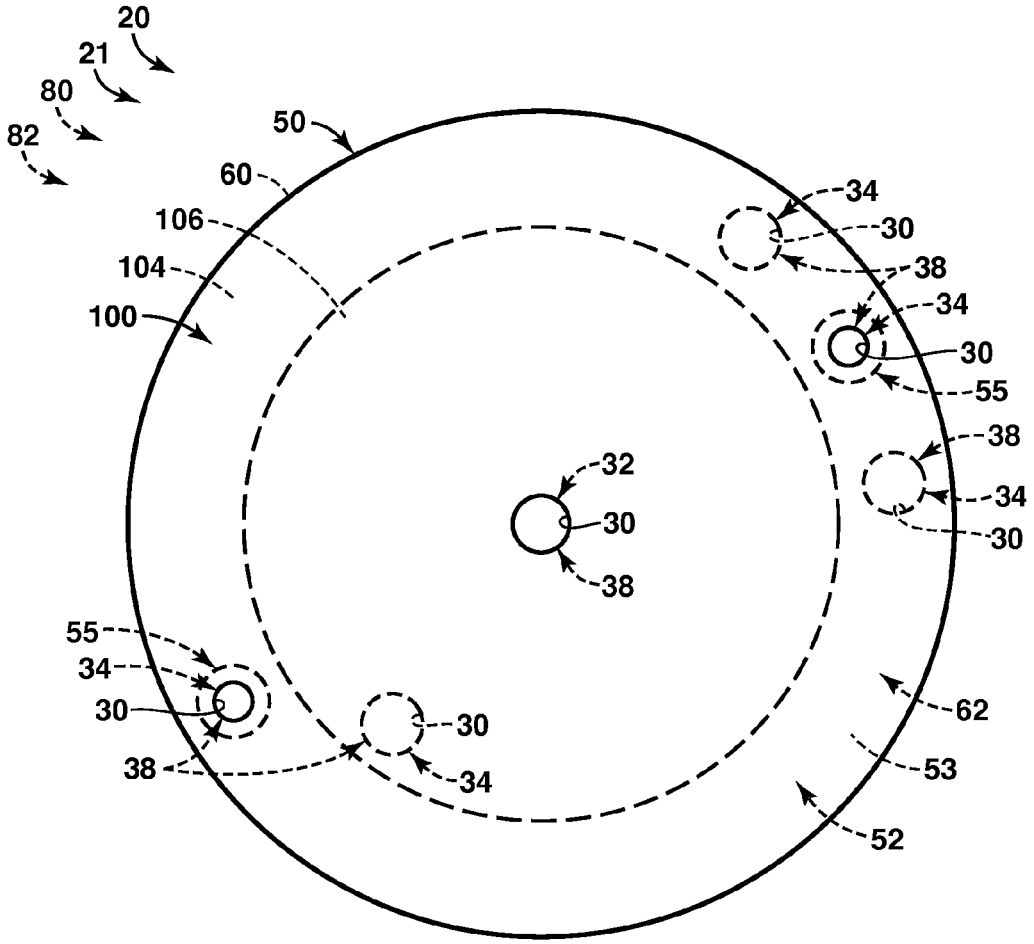
FIG. 2 is a schematic top view of illustrative, non-exclusive examples of a subterranean structure that may be intersected by a plurality of wellbores according to the present disclosure.

It is within the scope of the present disclosure that marker material 100 may include a first marker material and a second marker material that is different from the first marker material. It is also within the scope of the present disclosure that, as shown schematically in FIG. 2, first marker material 104 may be distributed in a different portion, or region, of subterranean structure 50 than second marker material 106. This may include the first marker material being distributed in a region, or ring, that surrounds the second marker material, as shown in FIG. 2, or vice versa.

When present, the first marker material and the second marker material may be distributed in different regions of the subterranean structure using any suitable system and/or method. As an illustrative, non-exclusive example, and as discussed in more detail herein, the first marker material may be injected into the subterranean structure prior to the second marker material. As another illustrative, non-exclusive example, one or more flow characteristics of the first marker material may be selected to be different from those of the second marker material, which may cause and/or produce a segregation of the marker materials within the subterranean structure. As a further illustrative, non-exclusive example, the first and second marker materials may be delivered to the subterranean structure using different wells.

When marker material 100 includes the first marker material and the second marker material, it is within the scope of the present disclosure that detector 120 may be configured to determine one or more characteristics of the marker material that may indicate and/or identify the marker material as the first marker material and/or the second marker material. As illustrative, non-exclusive examples, the detector may be configured to detect differences in the size, shape, and/or emission from the first marker material and the second marker material.

Marker material 100, first marker material 104, and/or second marker material 106 may include any suitable structure and/or material that is configured to mark, denote, and/or otherwise indicate the presence of subterranean structure 50 and/or the intersection of wellbore 30 with the subterranean structure. Illustrative, non-exclusive examples of marker material 100 according to the present disclosure include any suitable micromarker, radio frequency identification (RFID) device, wireless identification (WID) device, long wavelength (LW) device, active device, passive device, micromaterial, electromagnetic material, magnetic material, fluorescent material, radioactive material, and/or piezoelectric material.

As an illustrative, non-exclusive example, marker material 100 may include magnetite. When marker material 100 includes magnetite, and with reference to FIG. 1, it is within the scope of the present disclosure that detector 120 may include and/or be a bulk magnetic susceptibility meter that is configured to detect the magnetic susceptibility of one or more materials that may be proximal to the bulk magnetic susceptibility meter.

A magnetic susceptibility of magnetite, which is approximately 3,000,000 micro SI units, may be many orders of magnitude larger than a magnetic susceptibility of a remainder of the materials that may be present within subterranean region 45. As illustrative, non-exclusive examples, the magnetic susceptibility of magnetite may be at least 100, at least 250, at least 500, at least 750, at least 1,000, at least 5,000, at least 10,000, at least 15,000, at least 20,000, or at least 25,000 times larger than the magnetic susceptibility of the remainder of the materials that may be present within the subterranean region and/or a concentration-based average thereof. This large difference in magnetic susceptibility, which also may be referred to herein as a magnetic susceptibility contrast, may provide for accurate detection of relatively low concentrations of magnetite by detector 120.

When magnetic material 100 includes magnetite, the magnetite may be present within the subterranean structure as a plurality of discrete magnetite particles, each of which may include at least one north magnetic pole and at least one south magnetic pole. It is within the scope of the present disclosure that at least a coherent fraction of the plurality of discrete magnetite particles may be aligned within the subterranean structure with their north poles pointing within a threshold coherence angle of the same direction. As an illustrative, non-exclusive example, the threshold coherence angle may include an angle of less than 30 degrees, less than 25 degrees, less than 20 degrees, less than 15 degrees, less than 10 degrees, less than 5 degrees, less than 3 degrees, or less than 1 degree. As another illustrative, non-exclusive example, the coherent fraction may include at least 25%, at least 40%, at least 50%, at least 60%, at least 70%, at least 75%, at least 80%, or at least 90% of the plurality of discrete magnetite particles.

It is within the scope of the present disclosure that at least a single domain fraction of the plurality of discrete magnetite particles may include only one magnetic domain. Illustrative, non-exclusive examples of the single domain fraction according to the present disclosure include single domain fractions of at least 25%, at least 30%, at least 40%, at least 50%, at least 60%, at least 70%, at least 75%, at least 80%, at least 90%, at least 95%, or at least 99% of the plurality of discrete magnetite particles.

Additionally or alternatively, at least a multi-domain fraction of the plurality of discrete magnetite particles may include a plurality of magnetic domains. Illustrative, non-exclusive examples of the multi-domain fraction of the plurality of discrete magnetite particles include multi-domain fractions of less than 90%, less than 80%, less than 75%, less than 70%, less than 60%, less than 50%, less than 40%, less than 30%, less than 25%, less than 20%, less than 10%, or less than 5% of the plurality of discrete magnetite particles.

When the marker material includes the multi-domain fraction of the plurality of discrete magnetite particles, it is within the scope of the plurality of magnetic domains within each of the multi-domain magnetic particles may be aligned with one another to within a threshold alignment angle. Illustrative, non-exclusive examples of threshold alignment angles according to the present disclosure include threshold alignment angles of less than 30 degrees, less than 25 degrees, less than 20 degrees, less than 15 degrees, less than 10 degrees, less than 5 degrees, less than 3 degrees, or less than 1 degree. The plurality of magnetic domains may be aligned using any suitable system and/or method. As illustrative, non-exclusive examples, the plurality of magnetic domains may be aligned by heating the plurality of discrete magnetite particles, applying a magnetic field to the plurality of discrete magnetite particles to at least substantially align the plurality of magnetic domains, and cooling the plurality of discrete magnetite particles to maintain the plurality of magnetic domains in the at least substantially aligned configuration.

Subsequent to formation of wellbore 30, and as indicated at 160 in FIG. 1, wellbore 30 may be utilized as an electrode well 34 to provide an electric current through an electrical conduit 35 to granular resistive heater 52. As shown in dash-dot-dot lines, electrode well 34 may include and/or contain a supplemental material 54. As an illustrative, non-exclusive example, the electrode well may include a particulate conductor 55 that is configured to provide an electrical connection between electrical conduit 35 and granular resistive heater 52 and/or to more evenly distribute the electric current that flows through the electrical conductor into the granular resistive heater.

Figure 4:
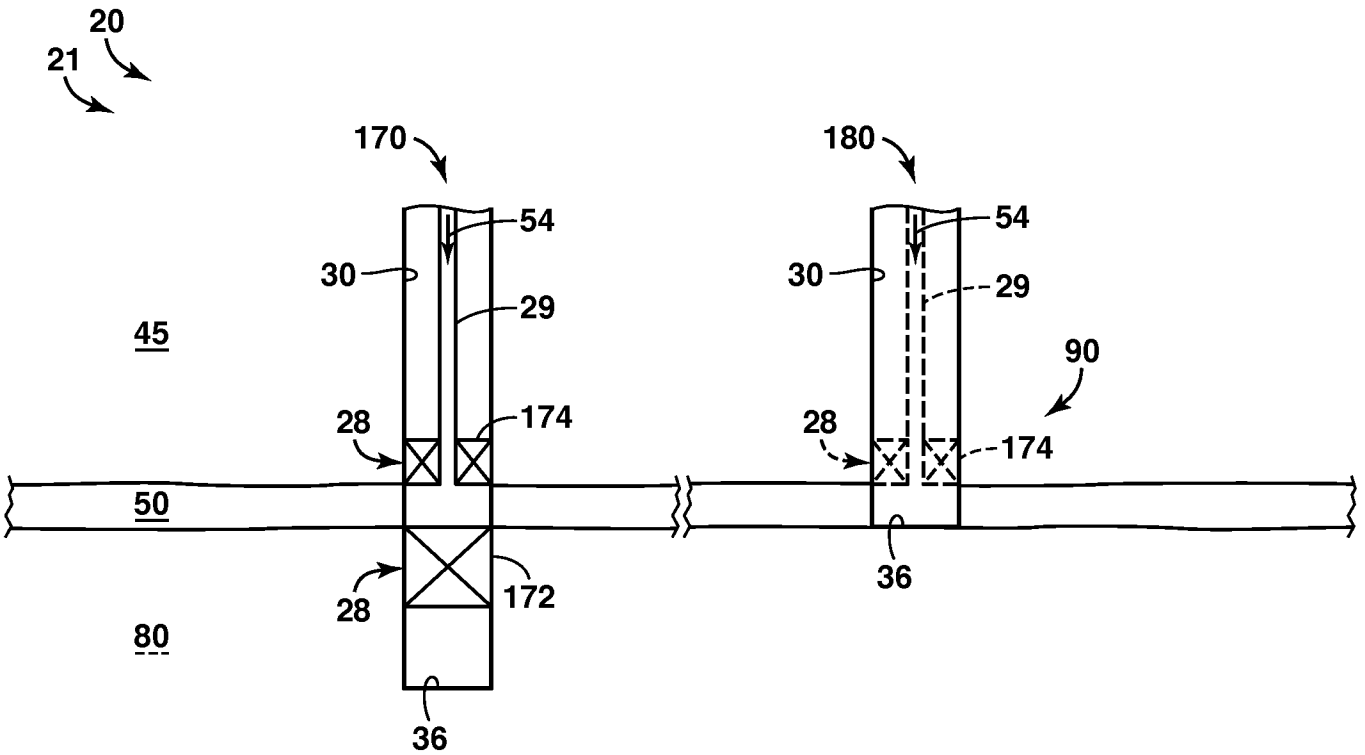
FIG. 4 is a schematic cross-sectional view of illustrative, non-exclusive examples of the use of one or more packers to focus, or target, delivery of a supplemental material to a subterranean structure.

As discussed in more detail herein with reference to FIG. 4, it may be desirable to provide for accurate supply of supplemental material 54 to a portion of wellbore 30 that includes subterranean structure 50. As an illustrative, non-exclusive example, this may include supplying supplemental material 54 to the portion of the wellbore that includes granular resistive heater 52. This may be accomplished through accurate control of terminal depth 36 of wellbore 30 and/or accurate detection of intersection point 90. However, and as discussed in more detail herein, thickness 58 of the granular resistive heater in a region that is proximal to the electrode well may be only on the order of a few millimeters. Thus, it may be difficult to accurately detect intersection point 90 without the use of the systems and methods that are disclosed herein.

Additionally or alternatively, and as discussed in more detail herein, it may be desirable to determine, or approximate, thickness 58 of the granular resistive heater in a region that is proximal to the electrode well in order to determine, or evaluate, an effectiveness of the electrode well at supplying the electric current to the granular resistive heater and/or to evaluate the need for additional electrode well(s) and/or the location(s) thereof. As an illustrative, non-exclusive example, if thickness 58 is less than a target, or threshold, thickness, the granular resistive heater may be too thin to effectively heat subterranean formation 80 and/or the portion of the granular resistive heater that is proximal to the electrode well may be too thin to adequately conduct the electric current to a remainder of the granular resistive heater. Under these conditions, a new electrode well may be drilled to replace and/or supplement the current electrode well. This new electrode well may be drilled at a location that is closer to stimulation well 32 in an effort to intersect granular resistive heater 52 at a thicker location. As another illustrative, non-exclusive example, and if thickness 58 is greater than a target, or threshold, thickness, it may be desirable to drill a new electrode well at a location that is farther from stimulation well 32 in an effort to increase the overall size and effectiveness of the granular resistive heater.

FIG. 2 is a schematic top view of illustrative, non-exclusive examples of subterranean structure 50 that may be intersected by a plurality of wellbores 30 according to the present disclosure. FIG. 2 illustrates that, as discussed in more detail herein, a stimulation well 32 may be present within a central region, or zone, of subterranean structure 50, and may be utilized to create a fracture 60. Fracture 60 may contain proppant 62, in the form of and/or including granular resistive heating material 53, which may form granular resistive heater 52. Subterranean structure 50 also may include marker material 100 that may be utilized to detect the intersection point between electrode wells 34 and the subterranean structure.

As also discussed in more detail herein, and as shown in dashed lines in FIG. 2, marker material 100 may include a first marker material 104 and a second marker material 106 that may be distributed in different zones, or regions, of the subterranean structure. A plurality of electrode wells 34 may provide electric current to and/or remove electric current from granular resistive heater 52, and supplemental material 54 may be proximal to and/or surround electrode wells 34 to provide for uniform supply of the electric current to the granular resistive heater. In addition, and as also shown in dashed lines in FIG. 2, any wellbore 30, including stimulation well(s) 32 and/or electrode well(s) 34 also may be, include, and/or be utilized as hydrocarbon wells 38, which also may be referred to herein as production wells 38.

FIG. 3 is a schematic cross-sectional view of illustrative, non-exclusive examples of an electrical connection 37 between a subterranean structure 50 that includes a granular resistive heater 52 and an electrical conduit 35. As schematically depicted in FIG. 3, granular resistive heater 52 may include a granular resistive heating material 53, which also may function and/or be referred to as a proppant 62, and a marker material 100 in the form of a plurality of discrete marker bodies. The granular resistive heating material may include any suitable size and/or characteristic dimension. As an illustrative, non-exclusive example, an average characteristic dimension of the granular resistive heating material may be at least 50, at least 75, at least 80, at least 90, at least 100, at least 110, at least 120, or at least 125 micrometers. Additionally or alternatively, the average characteristic dimension may less than 200, less than 175, less than 150, less than 125, or less than 100 micrometers.

In the illustrative, non-exclusive example of FIG. 3, marker material 100 is shown schematically as being present within interstitial spaces between individual granular resistive heating material 53 and/or proppant 62 particles. As discussed in more detail herein, such a configuration may exist when marker material 100 is separate from proppant 62 and provided to the subterranean structure concurrently with and/or subsequent to proppant 62. Additionally or alternatively, and as indicated in FIG. 3 at 103, it is also within the scope of the present disclosure that the marker material may form a portion of, be incorporated into, and/or be proppant 62. When the marker material is separate from proppant 62 and provided to the subterranean structure subsequent to the proppant, it is within the scope of the present disclosure that the average characteristic dimension of the plurality of discrete marker material particles, illustrative, non-exclusive examples of which are discussed in more detail herein, may be less than an average pore size of the interstitial spaces that are present within the granular resistive heater.

As discussed in more detail herein, and subsequent to formation of wellbore 30 that is associated with electrode well 34, supplemental material 54 may be provided to a region of the wellbore that is in fluid communication with granular resistive heater 52. The supplemental material may form an electrical connection between electrical conduit 35 and granular resistive heating material 53 of the granular resistive heater, thereby decreasing a resistance to electric current flow and/or increasing a uniformity of electric current flow therebetween.

FIG. 4 is a schematic cross-sectional view of illustrative, non-exclusive examples of wellbores 30 that include one or more packers 28 to focus, or target, delivery of supplemental material 54 to subterranean structure 50 that may be present within subsurface region 45 and/or subterranean formation 80. As an illustrative, non-exclusive example, and as indicated in FIG. 4 at 170, when terminal depth 36 of wellbore 30 extends below subterranean structure 50, a packer 172 may be placed within the wellbore and below the subterranean structure to limit a flow of supplemental material 54 therepast. In addition, a second packer 174 may be placed within the wellbore and above the subterranean structure and a fluid conduit 29 may be utilized to provide the supplemental material directly, or at least substantially directly, to the subterranean structure.

While the use of packers 172 and 174 may facilitate accurate delivery of the supplemental material to the subterranean structure, it may be time-consuming and/or comparatively expensive to locate the packers within wellbore 30. In addition, it may be difficult to determine a desired location for the packers, since a distance between terminal depth 36 and subterranean structure 50 may be unknown and/or difficult to determine.

In contrast, and as indicated in FIG. 4 at 180, the systems and methods disclosed herein may provide for accurate determination of intersection point 90 between wellbore 30 and subterranean structure 50. Thus, supplemental material 54 may be provided to the subterranean structure without the need for packer 172. In addition, a location for packer 174 may be accurately determined since a distance between terminal depth 36 and subterranean structure 50 is known. Furthermore, and when loss of supplemental material 54 through wellbore 30 is less than a threshold level, it is within the scope of the present disclosure that supplemental material 54 may be provided to subterranean structure 50 without the use of packer 174 and/or fluid conduit 29.

Figure 5:
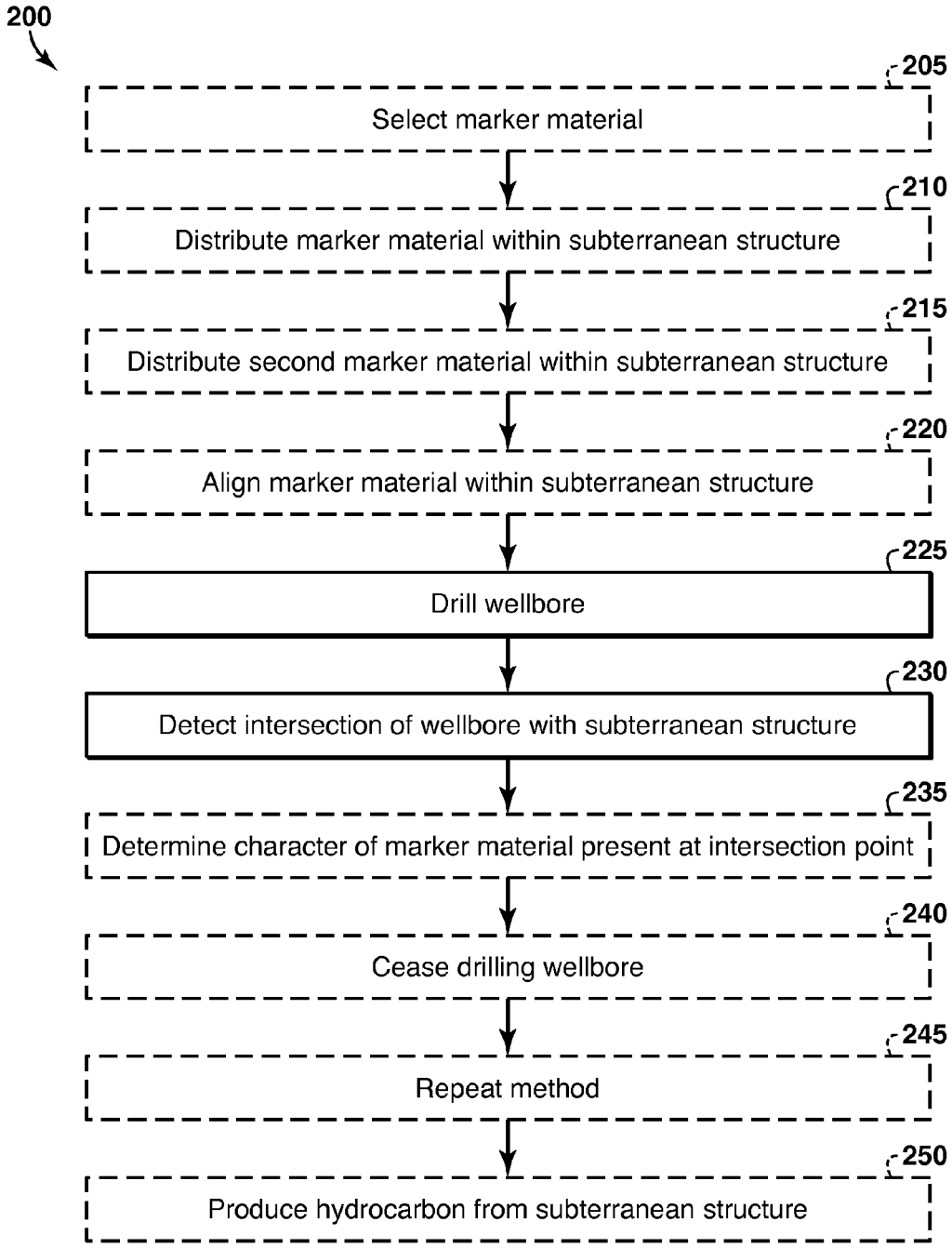
FIG. 5 is a flowchart depicting methods according to the present disclosure of detecting an intersection of a wellbore with a subterranean structure.

FIG. 5 is a flowchart depicting methods 200 according to the present disclosure of detecting an intersection of a wellbore with a subterranean structure. The methods may include selecting a marker material at 205, distributing the marker material within the subterranean structure at 210, distributing a second marker material within the subterranean structure at 215 and/or aligning the marker material within the subterranean structure at 220. The methods further may include drilling the wellbore at 225 and detecting an intersection, or intersection point, of the wellbore with the subterranean structure at 230. The methods further may include determining a character of the marker material that is present at the intersection point at 235, ceasing drilling the wellbore at 240, repeating the method at 245, and/or producing a hydrocarbon from the subterranean structure at 250.

Selecting the marker material at 205 may include the use of any suitable system, method, and/or criteria to select the marker material that may be distributed within the subterranean structure. Illustrative, non-exclusive examples of marker materials according to the present disclosure are discussed in more detail herein. As an illustrative, non-exclusive example, the selecting may include selecting the type, configuration, and/or materials of construction of the marker material. As another illustrative, non-exclusive example, the selecting may include selecting a shape, volume, density, and/or settling velocity of the plurality of discrete marker material particles that are included in the marker material based, at least in part, on a desired distribution of the discrete marker material particles within the subterranean structure, a density of a fluid that is present within the subterranean structure, a viscosity of the fluid that is present within the subterranean structure, and/or an average pore size within the subterranean structure.

Distributing the marker material within the subterranean structure at 210 may include the use of any suitable system and/or method to disperse, spread, and/or distribute the marker material within the subterranean structure. As an illustrative, non-exclusive example, the distributing may include injecting the marker material into the subterranean structure, such as through any suitable fluid conduit and/or casing. As another illustrative, non-exclusive example, the distributing may include injecting a slurry that includes the marker material and/or water into the subterranean structure. As another illustrative, non-exclusive example, the distributing may include injecting the marker material into the subterranean structure from a stimulation well that may be utilized to form at least a portion of the subterranean structure. It is within the scope of the present disclosure that the distributing may include producing or otherwise providing any suitable concentration of the marker material within the subterranean structure, including the illustrative, non-exclusive examples of which that are discussed in more detail herein.

As also discussed, the marker material may be incorporated into and/or form a portion of a proppant that is present within the subterranean structure. When the marker material is incorporated into the proppant, the distributing may include distributing the marker material with the proppant. Additionally or alternatively, and as also discussed in more detail herein, the marker material may be separate from the proppant. When the marker material is separate from the proppant, the distributing may include distributing the marker material subsequent to supplying the proppant to the subterranean structure.

Although it is within the scope of the present disclosure that the marker material may include only a single type of marker material, the marker material also may include a first marker material and a second marker material. When the marker material includes the first marker material and the second marker material, the methods further may include distributing the second marker material at 215. The distributing may include distributing the first marker material into a different portion of the subterranean structure than the second marker material and/or distributing the first marker material in a ring around the second marker material. As illustrative, non-exclusive examples, this may include injecting the first marker material and the second marker material into the subterranean structure at different locations, injecting the first marker material into the subterranean structure at a different time than the second marker material, and/or selecting one or more flow properties of the first marker material to be different from one or more flow properties of the second marker material such that the marker materials naturally concentrate within different portions of the subterranean structure.

When first and second different marker materials are utilized, one or more properties of the first marker material may differ from a corresponding property of the second marker material. As illustrative, non-exclusive examples, a shape, volume, density, settling velocity, size, material of construction, excitation mode, and/or emission of the first marker material may be selected to be different from a corresponding property of the second marker material.

Aligning the marker material at 220 may include the use of any suitable system and/or method to align at least a portion of the plurality of discrete marker material particles that may be present within the subterranean structure. As an illustrative, non-exclusive example, a portion of the plurality of discrete marker material particles may include and/or be an elongate structure that includes a longitudinal axis, and the aligning may include aligning the longitudinal axis of the portion of the plurality of discrete marker material particles. As discussed, it is within the scope of the present disclosure that the aligning may include aligning the longitudinal axis of the portion of the plurality of discrete marker material particles along a common axis and/or aligning the longitudinal axis of the portion of the plurality of discrete marker material particles within and/or parallel to a common plane.

As illustrative, non-exclusive examples, the aligning may include flowing the marker material through the subterranean structure, flowing a fluid past the marker material after the marker material is present within the subterranean structure, applying an electric field to the marker material within the subterranean structure, applying a magnetic field to the marker material within the subterranean structure, and/or self-alignment of the marker material within the subterranean structure. When the aligning is utilized, a coherent fraction of the plurality of discrete marker material particles may be aligned to within a threshold coherence angle of the same direction. Illustrative, non-exclusive examples of the coherent fraction and/or the threshold coherence angle are discussed in more detail herein.

It is within the scope of the present disclosure that the aligning may improve and/or increase a sensitivity of the detecting at 230. As an illustrative, non-exclusive example, the aligning may improve and/or increase a coherence of one or more electric, magnetic, and/or electromagnetic fields that may be associated with the marker material and/or utilized by the detector during the detecting. When the marker material includes magnetite, the aligning may include aligning the magnetite into a coherent, or at least substantially coherent layer within the subterranean structure. A magnetic field strength of the coherent layer of magnetite may be much larger than a magnetic field strength of the discrete, or individual, magnetite particles that are present within the magnetite when they are not aligned. Thus, a detector that is configured to detect magnetic field strength and/or magnetic susceptibility may detect the subterranean structure with higher accuracy and/or greater resolution when the magnetite forms a coherent layer due to the increased magnetic field strength.

Drilling the wellbore at 225 may include the use of any suitable system and/or method to drill the wellbore. As illustrative, non-exclusive examples, and as discussed in more detail herein, the drilling may include the use of a drilling rig, a drill string, and/or a drill bit to drill the wellbore. Any suitable control system and/or control strategy may be utilized to control the drilling.

Detecting the intersection of the wellbore with the subterranean structure at 230 may include the use of any suitable system and/or method to detect the intersection point between the wellbore and the subterranean structure. As an illustrative, non-exclusive example, and as discussed in more detail herein, the detecting may include detecting the marker material with a detector that is attached to and/or forms a portion of the drill string, an illustrative, non-exclusive example of which includes a logging-while-drilling transducer. When the marker material is detected with a logging-while-drilling transducer, the logging-while-drilling transducer may be located near the drill bit that is associated with the drill string and/or near a terminal end of the drill string. As illustrative, non-exclusive examples, the logging-while-drilling transducer may be less than 1 meter, less than 0.75 meters, less than 0.5 meters, less than 0.25 meters, or less than 0.1 meters from the drill bit and/or the terminal end of the drill string. When the marker material includes magnetite, the logging-while-drilling transducer may include a bulk susceptibility meter that is configured to detect a bulk magnetic susceptibility of cuttings that are produced during the drilling.

As another illustrative, non-exclusive example, and as also discussed in more detail herein, the detecting may include remotely detecting the marker material. As illustrative, non-exclusive examples, the remotely detecting may include supplying a signal electric field, a signal magnetic field, and/or signal electromagnetic radiation to the marker material and/or receiving a resultant electric field, a resultant magnetic field, and/or resultant electromagnetic radiation from the marker material over a separation distance between the marker material and the detector. Illustrative, non-exclusive examples of separation distances according to the present disclosure are discussed in more detail herein.

Determining the character of the marker material at 235 may include the use of any suitable system and/or method to determine any suitable property of the marker material. As an illustrative, non-exclusive example, the determining may include detecting a concentration of the marker material. As another illustrative, non-exclusive example, and when the marker material includes the first marker material and the second marker material, the determining may include detecting an identity of the marker material and/or detecting a ratio of a concentration of the first marker material to a concentration of the second marker material.

Ceasing drilling the wellbore at 240 may include ceasing the drilling responsive, at least in part, to detecting the intersection at 230 and/or detecting the marker material. It is within the scope of the present disclosure that, as discussed in more detail herein, the ceasing may include ceasing such that a terminal depth of the wellbore is within a threshold distance of a target portion of the subterranean structure. Illustrative, non-exclusive examples of threshold distances according to the present disclosure include threshold distances of less than 1,000 millimeters (mm), less than 500 mm, less than 250 mm, less than 100 mm, less than 50 mm, less than 25 mm, less than 10 mm, less than 5 mm, less than 4 mm, less than 3 mm, less than 2 mm, less than 1 mm, less than 0.5 mm, or less than 0.1 mm. Illustrative, non-exclusive examples of target portions of the subterranean structure include a top surface, a bottom surface, a midline, and/or a central region of the subterranean structure.

Repeating the method at 245 may include repeating at least drilling the wellbore at 225 and detecting the intersection at 230 based on any suitable criteria. As an illustrative, non-exclusive example, the repeating may include drilling a second wellbore responsive, at least in part, to the detecting at 230 and/or the determining at 235.

Producing hydrocarbons from the subterranean structure at 250 may include the use of any suitable system and/or method to pump and/or otherwise convey one or more hydrocarbons from the subterranean structure. As illustrative, non-exclusive examples, the producing may include generating a liquid and/or gaseous hydrocarbon within the subterranean formation and/or the subterranean structure and/or pumping the one or more hydrocarbons from the subterranean formation and/or the subterranean structure to surface region 40.

Figure 6:
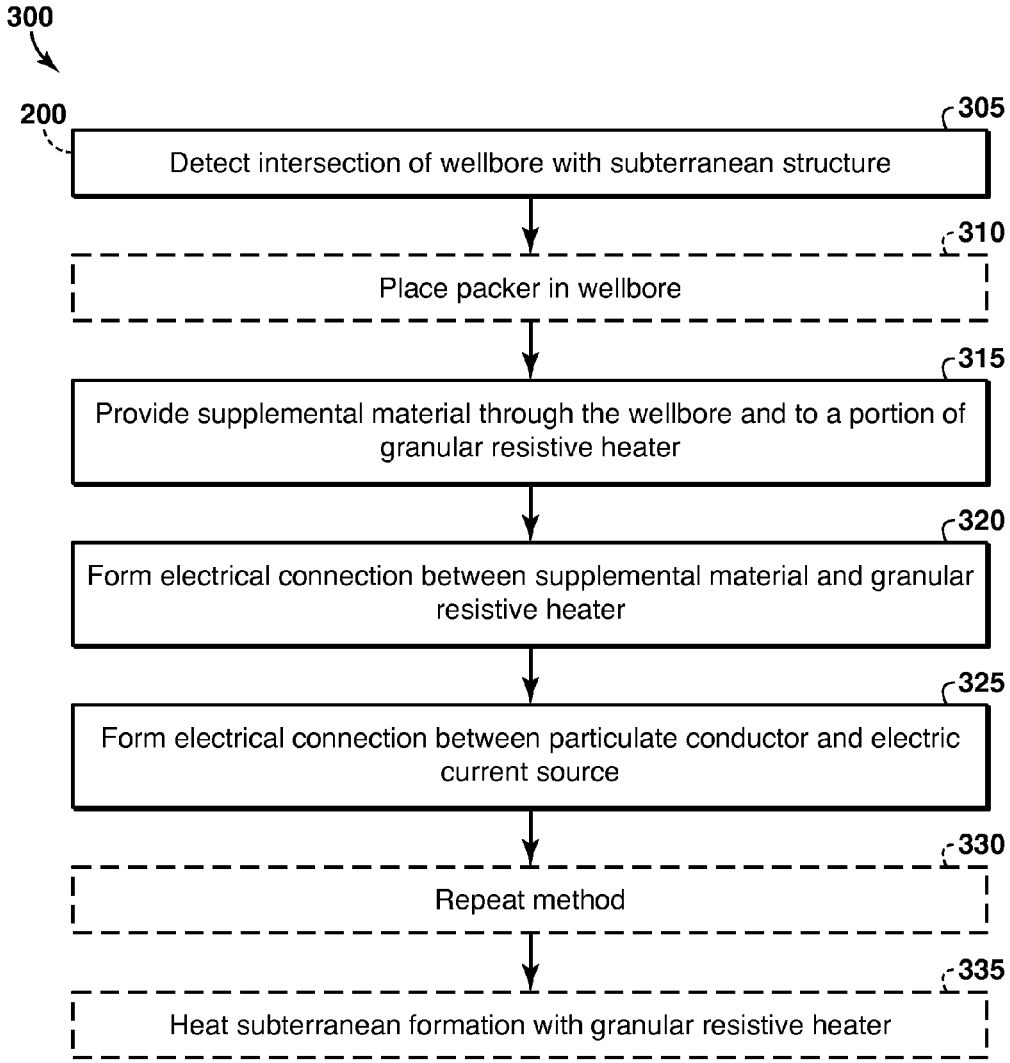
FIG. 6 is a flowchart depicting methods according to the present disclosure of forming an electrical connection between a granular resistive heater and an electric current source.

FIG. 6 is a flowchart depicting methods 300 according to the present disclosure of forming an electrical connection between a granular resistive heater that is present within a subterranean structure and an electric current source. The methods include detecting an intersection of a wellbore with the subterranean structure at 305 and may include placing one or more packers within the wellbore at 310. The methods further include providing a particulate conductor through the wellbore and to a portion of the granular resistive heater at 315, forming an electrical connection between the particulate conductor and the granular resistive heater at 320, and forming an electrical connection between the particulate conductor and the electric current source at 325. The methods further many include repeating the method at 330 and/or heating the subterranean formation with the granular resistive heater at 335.

Detecting the intersection of the wellbore with the subterranean structure at 305 may include the use of any suitable system and/or method to determine that the wellbore has intersected, contacted, and/or is in fluid communication with the subterranean structure. As an illustrative, non-exclusive example, the detecting may include performing methods 200 to detect the intersection of the wellbore with the subterranean structure.

Placing one or more packers within the wellbore at 310 may include the use of any suitable packer to occlude flow of fluid into one or more portions of the wellbore and/or to maintain a fluid that is provided to the wellbore within a target, or desired, portion of the wellbore. As an illustrative, non-exclusive example, the placing may include placing the one or more packers within the wellbore and adjacent to the subterranean structure. As another illustrative, non-exclusive example, the placing may include placing a packer uphole from the subterranean structure and/or placing a packer downhole from the subterranean structure.

Providing the supplemental material to the granular resistive heater at 315 may include providing any suitable supplemental material to any suitable portion of the granular resistive heater. As an illustrative, non-exclusive example, and as discussed in more detail herein, the providing may include providing the supplemental material to a portion of the granular resistive heater that is proximal to the wellbore. As another illustrative, non-exclusive example, the providing may include flowing the particulate conductor into the portion of the granular resistive heater that is proximal to the wellbore. As another illustrative, non-exclusive example, the providing may include pumping a slurry that includes the supplemental material into the wellbore. As yet another illustrative, non-exclusive example, and when the methods include placing one or more packers in the wellbore at 310, the providing may include providing the supplemental material to a portion of the wellbore that is bounded by at least one of the one or more packers and which includes the subterranean structure.

The supplemental material may include any suitable material that is configured to provide an electrical connection between the granular resistive heater and the electric current source, illustrative, non-exclusive examples of which include a particulate conductor, carbon, graphite, a metallic material, a metal particulate, and/or metal hairs/strands. Similarly, the supplemental material may include any suitable size, average size, and/or size distribution. As an illustrative, non-exclusive example, and as discussed in more detail herein, the granular resistive heater may include a porous structure that includes an average pore size and an average characteristic dimension of the supplemental material may be less than the average pore size.

Forming electrical connections at 320 and 325 may include the use of any suitable structure to form an electrical connection between the granular resistive heater and the electric current source. As illustrative, non-exclusive examples, the forming may include flowing the supplemental material into a portion of the granular resistive heater such that a portion of the supplemental material is in electrical communication with the portion of the granular resistive heater, filling a portion of the wellbore with the supplemental material, and/or placing an electrical conduit in electrical communication with both the supplemental material and the electric current source.

Repeating the method at 330 may include repeating the method to form a second (and/or subsequent) well and/or wellbore that may be utilized to form a second electrical connection between the electric current source and the granular resistive heater. It is within the scope of the present disclosure that the two (or more) wellbores may be spaced apart from each another. As illustrative, non-exclusive examples, a stimulation well may be at least substantially between the two or more wellbores. As another illustrative, non-exclusive example, the wellbores may be located on at least substantially opposite sides of the granular resistive heater or otherwise distributed in a spaced relation therein.

Heating the subterranean formation at 335 may include providing an electric current to the granular resistive heater from the electric current source, generating heat with the granular resistive heater due to the flow of electric current therethrough, and/or conducting the heat that is generated by the granular resistive heater into the subterranean formation. It is within the scope of the present disclosure that the heating may include performing a shale oil retort process, a shale oil heat treating process, a hydrogenation process, a thermal dissolution process, and/or an in situ shale oil conversion process within the subterranean formation. It is also within the scope of the present disclosure that the heating may include converting a hydrocarbon, such as kerogen and/or bitumen, that is present within the subterranean formation into a liquid hydrocarbon, a gaseous hydrocarbon, and/or shale oil that may be produced from the subterranean formation by one or more production wells.

Figure 7:
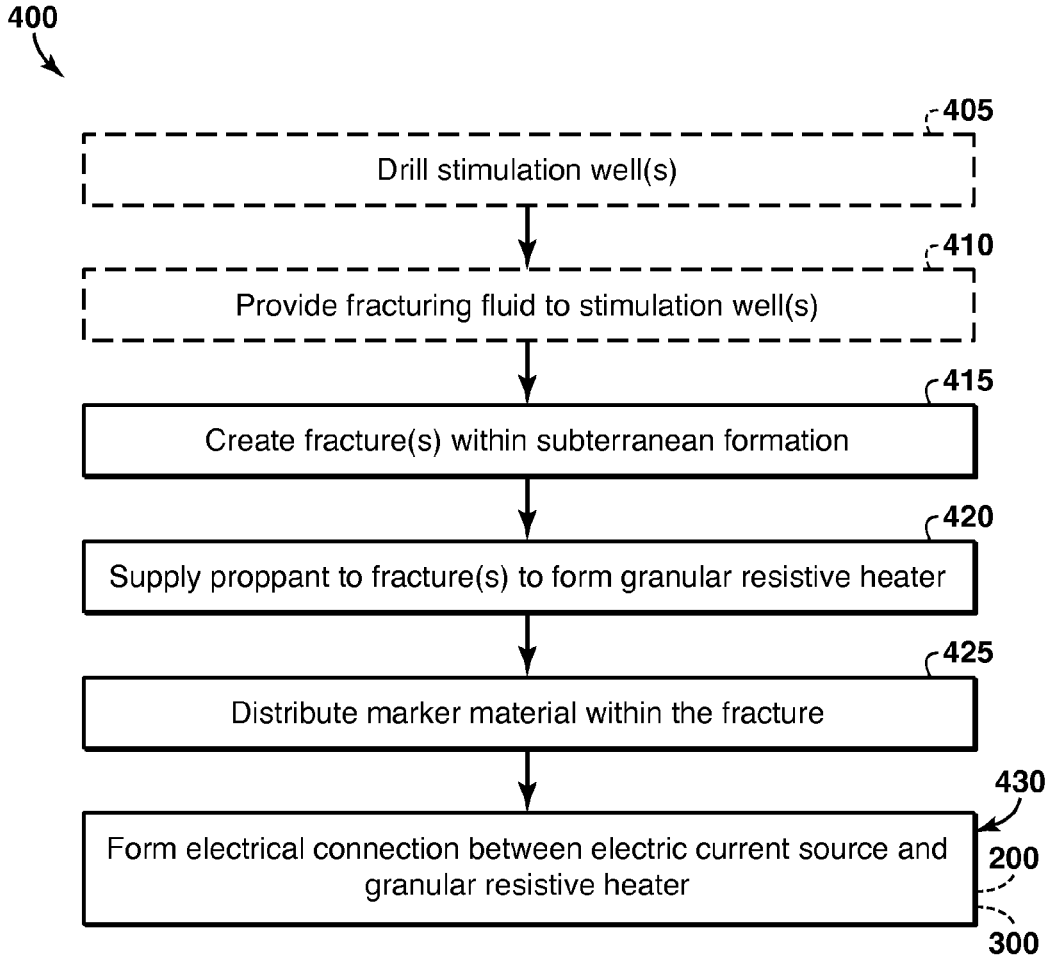
FIG. 7 is a flowchart depicting methods according to the present disclosure of forming a subterranean structure that includes a granular resistive heater.

FIG. 7 is a flowchart depicting methods 400 according to the present disclosure of forming a subterranean structure that includes a granular resistive heater. The methods may include drilling one or more stimulation wells at 405 and providing a fracturing fluid to the one or more stimulation wells at 410. The methods further include creating one or more fractures within the subterranean formation 415, supplying a proppant to the one or more fractures to form the granular resistive heater 420, distributing a marker material within the fracture and/or the granular resistive heater at 425, and/or forming an electrical connection between an electric current source and the granular resistive heater at 430.

Drilling one or more stimulation wells at 405 may include the use of any suitable system and/or method to drill a stimulation well into the subterranean formation. The one or more stimulation wells may be configured to provide a stimulant fluid to the subterranean formation to stimulate production from the subterranean formation.

Providing the fracturing fluid to the one or more stimulation wells at 410 may include providing any suitable fluid that is configured to stimulate the subterranean formation. As an illustrative, non-exclusive example, the providing may include increasing a hydraulic pressure within a portion of the subterranean formation and/or creating the one or more fractures within the subterranean formation at 415.

It is within the scope of the present disclosure that each of the one or more fractures may include any suitable orientation and/or be of any suitable size. As illustrative, non-exclusive examples, the one or more fractures may include at least substantially vertical and/or at least substantially horizontal fractures. As another illustrative, non-exclusive example, the one or more fractures may include at least substantially planar fractures.

Supplying the proppant to the one or more fractures at 420 may include supplying any suitable proppant that is configured to maintain the one or more fractures in an open configuration. As an illustrative, non-exclusive example, the proppant may include a porous structure that is configured to provide for fluid flow therethrough. As another illustrative, non-exclusive example, the proppant may include a granular resistive heating material that forms a portion of the granular resistive heater. As another illustrative, non-exclusive example, the granular resistive heating material may include a resistive material that is configured to generate heat when an electric current is passed therethrough, an illustrative, non-exclusive example of which includes calcined petroleum coke.

Distributing the marker material within the fracture at 425 may include the use of any suitable system and/or method to distribute the marker material. As an illustrative, non-exclusive example, and as discussed in more detail herein, the distributing may include distributing a first marker material and a second marker material into the fracture. As another illustrative, non-exclusive example, the distributing may include distributing the first marker material into a different portion of the fracture than the second marker material. As yet another illustrative, non-exclusive example, and when the methods include creating a plurality of fractures, the distributing may include distributing the first marker material into a first fracture of the plurality of fractures and distributing the second marker material into a second fracture of the plurality of fractures.

As discussed in more detail herein, it is within the scope of the present disclosure that the marker material may be separate from the proppant. When the marker material is separate from the proppant, the marker material may be configured, designed, and/or selected to have a settling velocity that is within a threshold difference of a settling velocity of the proppant. Illustrative, non-exclusive examples of threshold differences according to the present disclosure include threshold differences of less than 50%, less than 40%, less than 30%, less than 25%, less than 20%, less than 15%, less than 10%, less than 5%, or less than 1%. When a density of the marker material is significantly different from a density of the proppant, the marker material may be incorporated into a matrix material to form a composite marker material that includes a density that provides the desired settling velocity.

Additionally or alternatively, and as also discussed in more detail herein, it is also within the scope of the present disclosure that the marker material may form a portion of the proppant. When the marker material forms a portion of the proppant, the supplying at 420 also may include and/or may be performed concurrently with the distributing at 425.

Forming the electrical connection between the electric current source and the granular resistive heater at 430 may include the formation of any suitable electrode well that may be configured to provide the electrical connection. As an illustrative, non-exclusive example, the forming may include detecting an intersection of a wellbore that is associated with the electrode well and the granular resistive heater using methods 200 and/or forming the electrical connection between the granular resistive heater and the electric current source using methods 300.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Illustrative, non-exclusive examples of systems and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A method of detecting an intersection of a well that includes a wellbore with a subterranean structure, wherein the subterranean structure includes a marker material distributed therein, the method comprising:

drilling the wellbore; and determining that the wellbore has intersected a portion of the subterranean structure that includes the marker material, wherein the determining includes detecting the marker material.

A2. The method of paragraph A1, wherein the method further includes ceasing the drilling the wellbore, wherein the ceasing is responsive, at least in part, to the detecting.

A3. The method of paragraph A2, wherein the wellbore includes a terminal depth, and further wherein the ceasing includes ceasing the drilling such that the terminal depth of the wellbore is within 1,000 millimeters (mm), within 500 mm, within 250 mm, within 100 mm, within 50 mm, within 25 mm, within 10 mm, within 5 mm, within 4 mm, within 3 mm, within 2 mm, within 1 mm, within 0.5 mm, or within 0.1 mm of a target portion of the subterranean structure, optionally wherein the target portion includes a top surface, a bottom surface, or a central region of the subterranean structure.

A4. The method of any of paragraphs A1-A3, wherein the method further includes distributing the marker material within the subterranean structure.

A5. The method of paragraph A4, wherein the distributing includes injecting the marker material into the subterranean structure, optionally wherein the injecting includes injecting a slurry including the marker material and a liquid into the subterranean structure, and further optionally wherein the liquid includes water.

A6. The method of any of paragraphs A4-A5, wherein the distributing includes injecting the marker material into the subterranean structure from a stimulation well.

A7. The method of any of paragraphs A4-A6, wherein the distributing includes distributing the marker material into the subterranean structure such that a concentration of the marker material within the subterranean structure is less than 5 volume %, less than 3 volume %, less than 2 volume %, less than 1 volume %, less than 0.75 volume %, less than 0.5 volume %, less than 0.25 volume %, less than 0.1 volume %, less than 0.05 volume %, less than 0.01 volume %, or less than 0.005 volume %, and optionally greater than 0.001 volume %, greater than 0.005 volume %, greater than 0.01 volume %, greater than 0.05 volume %, greater than 0.1 volume %, greater than 0.25 volume %, or greater than 0.5 volume %.

A8. The method of any of paragraphs A4-A7, wherein the distributing includes at least one of distributing the marker material within a proppant that forms a portion of the subterranean structure and distributing the marker material with the proppant to form a portion of the subterranean structure.

A9. The method of paragraph A8, wherein the proppant includes a granular resistive heating material.

A10. The method of any of paragraphs A4-A9, wherein the marker material includes a plurality of discrete marker material particles, wherein at least a portion of the plurality of discrete marker material particles includes an elongate structure with a longitudinal axis, and further wherein the distributing includes aligning the longitudinal axis of the portion of the plurality of discrete marker material particles, wherein the aligning includes at least one of aligning the longitudinal axis of the portion of discrete marker material particles along a common axis and aligning the longitudinal axis of the portion of discrete marker material particles parallel to a common plane.

A11. The method of paragraph A10, wherein the aligning includes at least one of flowing the marker material through the subterranean structure, flowing a fluid past the marker material after the marker material is present within the subterranean structure, applying an electric field to the marker material within the subterranean structure, applying a magnetic field to the marker material within the subterranean structure, and self-alignment of the marker material within the subterranean structure.

A12. The method of any of paragraphs A1-A11, wherein the marker material includes magnetite, and further wherein the detecting includes detecting the magnetite, optionally wherein detecting the magnetite includes detecting a bulk magnetic susceptibility of cuttings that are produced while drilling the wellbore, and further optionally wherein the cuttings are produced at a terminal end of the wellbore.

A13. The method of paragraph A12, wherein the magnetite includes a plurality of discrete magnetite particles, wherein each of the plurality of discrete magnetite particles includes a plurality of magnetic poles including at least a north magnetic pole and a south magnetic pole.

A14. The method of paragraph A13, wherein the method includes aligning the plurality of discrete magnetite particles within the subterranean structure such that a coherent fraction of the plurality of discrete magnetite particles is aligned with their north poles pointing within a threshold coherence angle of the same direction, optionally wherein the coherent fraction includes at least 25%, at least 40%, at least 50%, at least 60%, at least 70%, at least 75%, at least 80%, or at least 90% of the plurality of discrete magnetite particles, and further optionally wherein the threshold coherence angle includes an angle of less than 30 degrees, less than 25 degrees, less than 20 degrees, less than 15 degrees, less than 10 degrees, less than 5 degrees, less than 3 degrees, or less than 1 degree.

A15. The method of any of paragraphs A13-A14, wherein each of the plurality of discrete magnetite particles in a single domain fraction of the plurality of discrete magnetite particles includes only one magnetic domain, and optionally wherein the single domain fraction includes at least 25%, at least 30%, at least 40%, at least 50%, at least 60%, at least 70%, at least 75%, at least 80%, at least 90%, at least 95%, or at least 99% of the plurality of discrete magnetite particles.

A16. The method of any of paragraphs A13-A15, wherein each of the plurality of discrete magnetite particles in a multi-domain fraction of the plurality of discrete magnetite particles includes a plurality of magnetic domains, and optionally wherein the multi-domain fraction includes less than 90%, less than 80%, less than 75%, less than 70%, less than 60%, less than 50%, less than 40%, less than 30%, less than 25%, less than 20%, less than 10%, or less than 5% of the plurality of discrete magnetite particles.

A17. The method of paragraph A16, wherein the plurality of magnetic domains are aligned with one another to within a threshold alignment angle, optionally wherein the threshold alignment angle is less than 30 degrees, less than 25 degrees, less than 20 degrees, less than 15 degrees, less than 10 degrees, less than 5 degrees, less than 3 degrees, or less than 1 degree.

A18. The method of paragraph A17, wherein the method further includes aligning the plurality of magnetic domains to within the threshold alignment angle, optionally wherein the aligning includes heating the plurality of discrete magnetite particles, applying a magnetic field to the plurality of discrete magnetite particles, and cooling the plurality of discrete magnetite particles, and further optionally wherein the cooling includes cooling at least substantially concurrently with applying the magnetic field.

A19. The method of any of paragraphs A1-A18, wherein the detecting includes detecting the marker material with a logging-while-drilling transducer.

A20. The method of paragraph A19, wherein the logging-while-drilling transducer is located on a drill string utilized for drilling the wellbore, optionally wherein the logging-while-drilling transducer is within a threshold distance of at least one of a drill bit that is associated with the drill string and a terminal end of the drill string, and further optionally wherein the threshold distance is less than 1 meter, less than 0.75 meters, less than 0.5 meters, less than 0.25 meters, or less than 0.1 meters.

A21. The method of any of paragraphs A1-A20, wherein the wellbore forms a portion of a hydrocarbon well that is configured to convey a hydrocarbon from a subterranean formation that includes the subterranean structure to a surface region.

A22. The method of paragraph A21, wherein the method further includes producing a hydrocarbon from the subterranean formation.

A23. The method of any of paragraphs A1-A22, wherein the marker material includes a plurality of discrete marker bodies, and further wherein the detecting includes detecting at least a portion of the plurality of discrete marker bodies.

A24. The method of paragraph A23, wherein the method includes selecting at least one of a shape, a volume, a density, and a settling velocity of the plurality of discrete marker bodies based, at least in part, upon a desired distribution of the plurality of discrete marker bodies within the subterranean structure, and optionally wherein the selecting is based, at least in part, on a density of a fluid present within the subterranean structure, a viscosity of the fluid present within the subterranean structure, and an average pore size within the subterranean structure.

A25. The method of any of paragraphs A23-A24, wherein an average characteristic dimension of the plurality of discrete marker bodies is less than 250, less than 200, less than 150, less than 125, less than 100, less than 75, less than 50, less than 25, less than 10, less than 5, less than 2, less than 1, less than 0.5, or less than or equal to 0.1 micrometers, and optionally wherein an average characteristic dimension of the plurality of discrete marker bodies is greater than 0.05, greater than 0.1, greater than 1, greater than 2, greater than 5, greater than 10, greater than 20, greater than 25, or greater than 50 micrometers.

A26. The method of any of paragraphs A23-A25, wherein the plurality of discrete marker bodies includes a plurality of elongate marker bodies.

A27. The method of any of paragraphs A23-A26 when dependent from paragraph A5, wherein the marker material includes a first marker material and a second marker material.

A28. The method of paragraph A27, wherein the distributing includes distributing the first marker material in a different portion of the subterranean structure than the second marker material, optionally by at least one of injecting the first marker material and the second marker material into the subterranean structure at different locations, injecting the first marker material at a different time than the second marker material, and selecting a flow property of the first marker material within the subterranean structure to be different form a flow property of the second marker material within the subterranean structure.

A29. The method of any of paragraphs A27-A28, wherein the detecting includes determining a characteristic of the marker material that is present at an intersection point between the wellbore and the subterranean structure, and optionally wherein the characteristic of the marker material includes at least one of an identity of the marker material, a concentration of the marker material, and a ratio of a concentration of the first marker material to a concentration of the second marker material.

A30. The method of paragraph A29, wherein the method further includes drilling a second wellbore at a second location, wherein the second location is selected based, at least in part, on the determining.

A31. The method of any of paragraphs A27-A30, wherein the distributing includes providing the first marker material to the subterranean structure prior to providing the second marker material to the subterranean structure.

A32. The method of any of paragraphs A27-A31, wherein the distributing includes selecting a property of the first marker material to be different from a property of the second marker material, and optionally wherein the property includes at least one of a shape, a volume, a density, a settling velocity, a size, a material of construction, an excitation mode, and an emission.

A33. The method of any of paragraphs A27-A32, wherein the distributing includes creating a ring of the first marker material around the second marker material within the subterranean structure.

A34. The method of any of paragraphs A1-A33, wherein the marker material includes at least one of a micromarker, an RFID device, a WID device, an LW device, an active device, a passive device, a micromaterial, an electromagnetic material, a fluorescent material, a radioactive material, and a piezoelectric material.

A35. The method of any of paragraphs A1-A34, wherein the detecting includes remotely detecting the marker material.

A36. The method of paragraph A35, wherein remotely detecting the marker material includes providing at least one of a signal electric field, a signal magnetic field, and signal electromagnetic radiation to the marker material over a separation distance and receiving at least one of a resultant electric field, a resultant magnetic field, and resultant electromagnetic radiation from the marker material over the separation distance, optionally wherein the separation distance is greater than 1 meter, greater than 5 meters, greater than 10 meters, greater than 25 meters, greater than 50 meters, greater than 100 meters, greater than 250 meters, greater than 500 meters, or greater than 1,000 meters, and further optionally wherein the separation distance is less than 10,000 meters, less than 7,500 meters, less than 5,000 meters, less than 2,500 meters, less than 1,000 meters, less than 750 meters, less than 500 meters, or less than 250 meters.

A37. The method of any of paragraphs A1-A36, wherein the detecting includes detecting the marker material by examining cuttings that are produced during the drilling.

A38. The method of paragraph A37, wherein the examining is at least one of performed in a surface region associated with the wellbore and performed proximal to a terminal end of the wellbore.

B1. A method of forming an electrical connection between an electric current source and a granular resistive heater that forms a portion of a subterranean structure, the method comprising:

detecting an intersection of a wellbore with the subterranean structure using the method of any of paragraphs A1-A38;

providing a supplemental material to a portion of the granular resistive heater that is proximal to the wellbore;

forming an electrical connection between the supplemental material and the granular resistive heater; and forming an electrical connection between the supplemental material and an electrical conduit that is configured to convey an electrical current between the granular resistive heater and the electric current source.

B2. The method of paragraph B1, wherein the supplemental material includes at least one of a particulate conductor, carbon, graphite, a metallic material, a metal particulate, and metal hairs, and optionally wherein providing the supplemental material includes pumping a slurry that includes the supplemental material into the wellbore.

B3. The method of any of paragraphs B1-B2, wherein the granular resistive heater forms a porous structure including an average pore size, and further wherein an average characteristic dimension of the supplemental material is less than the average pore size.

B4. The method of any of paragraphs B1-B3, wherein the method further includes placing one or more packers within the wellbore and adjacent to the subterranean structure.

B5. The method of paragraph B4, wherein the placing includes placing a packer uphole from the subterranean structure, and optionally wherein the placing includes placing a second packer downhole from the subterranean structure.

B6. The method of paragraph B4, wherein the placing includes placing a packer downstream from the subterranean structure.

B7. The method of any of paragraphs B4-B6, wherein providing the supplemental material includes providing the supplemental material to a portion of the wellbore that is bounded by at least one of the one or more packers and includes the subterranean structure.

B8. The method of any of paragraphs B1-B7, wherein the well is a first well, and further wherein the method includes repeating the method to form a second electrical connection between the electric current source and the granular resistive heater with a second well.

B9. The method of paragraph B8, wherein the first well is spaced apart from the second well, optionally wherein a stimulation well is at least substantially between the first well and the second well, and further optionally wherein the first well and the second well are located on at least substantially opposite sides of the granular resistive heater.

C1. A method of forming a granular resistive heater, wherein the granular resistive heater forms a portion of a subterranean structure that is present within a subterranean formation, the method comprising:

creating a fracture within the subterranean formation;

supplying a proppant to the fracture, wherein the proppant includes a porous structure that is configured to provide for fluid flow through the fracture, and further wherein the proppant includes a granular resistive heating material that forms the granular resistive heater;

distributing a marker material within the fracture; and forming an electrical connection between an electric current source and the granular resistive heater using the method of any of paragraphs A1-B9.

C2. The method of paragraph C1, wherein the method further includes drilling a stimulation well into the subterranean formation.

C3. The method of any of paragraphs C1-C2, wherein the creating includes providing a fracturing fluid to a/the stimulation well.

C4. The method of any of paragraphs C1-C3, wherein the method further includes cementing at least a portion of the proppant in place within the subterranean structure.

C5. The method of any of paragraphs C1-C4, wherein the method includes creating a plurality of fractures within the subterranean formation.

C6. The method of paragraph C5, wherein the plurality of fractures is associated with a/the stimulation well.

C7. The method of any of paragraphs C5-C6, wherein the method includes drilling a plurality of stimulation wells, and further wherein the creating a plurality of fractures includes creating a fracture that is associated with each of the plurality of stimulation wells.

C8. The method of any of paragraphs C5-C7, wherein at least a first portion of the plurality of fractures includes a different marker material than a second portion of the plurality of fractures.

C9. The method of any of paragraphs C1-C8, wherein creating the fracture includes creating at least one of a vertical fracture and a horizontal fracture.

C10. The method of any of paragraphs C1-C9, wherein the marker material is separate from the proppant.

C11. The method of paragraph C10, wherein the marker material is configured to have a settling velocity that is within a threshold difference of a settling velocity of the proppant, optionally wherein the threshold difference is less than 50%, less than 40%, less than 30%, less than 25%, less than 20%, less than 15%, less than 10%, less than 5%, or less than 1%.

C12. The method of any of paragraphs C10-C11, wherein the marker material forms a portion of a composite marker structure that includes a matrix material.

C13. The method of any of paragraphs C1-C9, wherein the marker material forms a portion of the proppant, and further wherein supplying the proppant includes providing the marker material concurrently with the proppant.

C14. The method of any of paragraphs C1-C13, wherein a portion of the granular resistive heater that is proximal to a/the stimulation well that is utilized to create the fracture includes an average stimulation well-proximal thickness, optionally wherein the average stimulation well-proximal thickness is at least 3 mm, at least 4 mm, at least 5 mm, at least 6 mm, at least 7 mm, or at least 8 mm and further optionally wherein the average stimulation well-proximal thickness is less than 12 mm, less than 11 mm, less than 10 mm, less than 9 mm, less than 8 mm, less than 7 mm, less than 6 mm, or less than 5 mm.

C15. The method of any of paragraphs C1-C14, wherein a portion of the granular resistive heater that is proximal to the wellbore includes an average wellbore-proximal thickness, optionally wherein the average wellbore-proximal thickness is at least 0.25 mm, at least 0.5 mm, at least 0.75 mm, at least 1 mm, at least 1.25 mm, at least 1.5 mm, at least 1.75 mm, at least 2 mm, at least 2.25 mm, or at least 2.5 mm and further optionally wherein the average wellbore-proximal thickness is less than 5 mm, less than 4 mm, less than 3.5 mm, less than 3 mm, less than 2.75 mm, less than 2.5 mm, less than 2.25 mm, less than 2 mm, less than 1.75 mm, less than 1.5 mm, less than 1.25 mm, or less than 1 mm.

C16. The method of any of paragraphs C1-C15, wherein the granular resistive heating material includes a resistive material that is configured to generate heat when an electric current is conducted therethrough, and optionally wherein the granular resistive heating material includes calcined petroleum coke.

C17. The method of any of paragraphs C1-C16, wherein the granular resistive heating material includes a plurality of discrete heating material bodies, optionally wherein an average characteristic dimension of the plurality of discrete heating material bodies is at least 50, at least 75, at least 80, at least 90, at least 100, at least 110, at least 120, or at least 125 micrometers, and further optionally wherein the average characteristic dimension of the plurality of discrete heating material bodies is less than 200, less than 175, less than 150, less than 125, or less than 100 micrometers.

C18. The method of any of paragraphs C1-C17, wherein a length of the granular resistive heater is at least 50, at least 60, at least 70, at least 80, at least 90, at least 100, at least 110, at least 125, or at least 150 meters.

C19. The method of any of paragraphs C1-C18, wherein a width of the granular resistive heater is at least 25, at least 30, at least 35, at least 40, at least 45, at least 50, at least 55, at least 60, or at least 70 meters.

C20. The method of any of paragraphs C1-C19, wherein the granular resistive heater is at least substantially planar.

D1. The method of any of paragraphs A1-C20, wherein the subterranean structure is present within a/the subterranean formation, and further wherein the subterranean formation contains a hydrocarbon.

D2. The method of paragraph D1, wherein the subterranean formation contains at least one of oil shale, tar sands, and organic-rich rock.

D3. The method of any of paragraphs D1-D2, wherein the hydrocarbon includes at least one of kerogen and bitumen.

D4. The method of any of paragraphs D1-D2 when dependent from any of paragraphs B1-C20, wherein the method further includes heating the subterranean formation with the granular resistive heater.

D5. The method of paragraph D4, wherein the heating includes performing at least one of a shale oil retort process, a shale oil heat treating process, a hydrogenation reaction, a thermal dissolution process, and an in situ shale oil conversion process within the subterranean formation.

D6. The method of any of paragraphs D4-D5, wherein the heating includes converting the hydrocarbon into at least one of a liquid hydrocarbon, a gaseous hydrocarbon, and shale oil.

D7. The use of any of the methods of any of paragraphs D1-D6 to produce hydrocarbons from the subterranean formation.

D8. Hydrocarbons produced by the method of any of paragraphs D1-D7.

D9. The method of any of paragraphs A1-D8, wherein the subterranean structure includes a man-made subterranean structure.

E1. A system configured to detect an intersection of a wellbore with a subterranean structure, the system comprising:

a marker material distributed within the subterranean structure; a drill string configured to drill the wellbore;

a detector configured to generate an intersection signal responsive to detecting the marker material; and a control system configured to control the operation of the drill string responsive, at least in part, to the intersection signal.

E2. The system of paragraph E1, wherein the control system includes at least one of a manually actuated control system, an automated control system, and a controller configured to perform the method of any of paragraphs A1-C18.

E3. The system of any of paragraphs E1-E2, wherein the detector includes a logging-while-drilling transducer that is located on the drill string, optionally wherein the logging-while-drilling transducer is within a threshold distance of at least one of a drill bit that is associated with the drill string and a terminal end of the drill string, and further optionally wherein the threshold distance is less than 1 meter, less than 0.75 meters, less than 0.5 meters, less than 0.25 meters, or less than 0.1 meters.

E4. The system of any of paragraphs E1-E3, wherein the detector includes a remote detector that is configured to remotely detect the marker material.

E5. The system of paragraph E4, wherein the remote detector is configured to provide at least one of a signal electric field, a signal magnetic field, and signal electromagnetic radiation to the marker material over a separation distance and receive at least one of a resultant electric field, a resultant magnetic field, and resultant electromagnetic radiation from the marker material over the separation distance, optionally wherein the separation distance is greater than 1 meter, greater than 5 meters, greater than 10 meters, greater than 25 meters, greater than 50 meters, greater than 100 meters, greater than 250 meters, greater than 500 meters, or greater than 1,000 meters, and further optionally wherein the separation distance is less than 10,000 meters, less than 7,500 meters, less than 5,000 meters, less than 2,500 meters, less than 1,000 meters, less than 750 meters, less than 500 meters, or less than 250 meters.

E6. The system of any of paragraphs E1-E5, wherein the detector includes a surface-based detector that is configured to examine cuttings that are produced while the wellbore is drilled.

E7. The system of any of paragraphs E1-E6, wherein the marker material includes magnetite, and further wherein the detector includes a bulk magnetic susceptibility meter.

E8. The system of paragraph E7, wherein the magnetite includes a plurality of discrete magnetite particles, wherein each of the plurality of discrete magnetite particles includes a plurality of magnetic poles including at least a north magnetic pole and a south magnetic pole.

E9. The system of any paragraph E8, wherein a coherent fraction of the plurality of discrete magnetite particles is aligned within the subterranean structure with their north poles pointing within a threshold coherence angle of the same direction, optionally wherein the coherent fraction includes at least 25%, at least 40%, at least 50%, at least 60%, at least 70%, at least 75%, at least 80%, or at least 90% of the plurality of discrete magnetite particles, and further optionally wherein the threshold coherence angle includes an angle of less than 30 degrees, less than 25 degrees, less than 20 degrees, less than 15 degrees, less than 10 degrees, less than 5 degrees, less than 3 degrees, or less than 1 degree.

E10. The system of any of paragraphs E8-E9, wherein each of the plurality of discrete magnetite particles in a single domain fraction of the plurality of discrete magnetite particles includes only one magnetic domain, and optionally wherein the single domain fraction includes at least 25%, at least 30%, at least 40%, at least 50%, at least 60%, at least 70%, at least 75%, at least 80%, at least 90%, at least 95%, or at least 99% of the plurality of discrete magnetite particles.

E11. The system of any of paragraphs E8-E10, wherein each of the plurality of discrete magnetite particles in a multi-domain fraction of the plurality of discrete magnetite particles includes a plurality of magnetic domains, and optionally wherein the multi-domain fraction includes less than 90%, less than 80%, less than 75%, less than 70%, less than 60%, less than 50%, less than 40%, less than 30%, less than 25%, less than 20%, less than 10%, or less than 5% of the plurality of discrete magnetite particles.

E12. The system of paragraph E11, wherein the plurality of magnetic domains are aligned with one another to within a threshold alignment angle, optionally wherein the threshold alignment angle is less than 30 degrees, less than 25 degrees, less than 20 degrees, less than 15 degrees, less than 10 degrees, less than 5 degrees, less than 3 degrees, or less than 1 degree.

E13. The system of any of paragraphs E1-E12, wherein the marker material includes a plurality of discrete marker bodies, and further wherein the detector is configured to generate the intersection signal responsive to detecting at least a portion of the plurality of discrete marker bodies.

E14. The system of paragraph E13, wherein at least one of a shape, a volume, a density, and a settling velocity of the plurality of discrete marker bodies is selected based, at least in part, upon at least one of a desired distribution of the plurality of discrete marker bodies within the subterranean structure, a density of a fluid present within the subterranean structure, a viscosity of the fluid present within the subterranean structure, and an average pore size within the subterranean structure.

E15. The system of any of paragraphs E13-E14, wherein an average characteristic dimension of the plurality of discrete marker bodies is less than 250, less than 200, less than 150, less than 125, less than 100, or less than 75 micrometers, and optionally greater than 2, greater than 5, greater than 10, greater than 20, greater than 25, or greater than 50 micrometers.

E16. The system of any of paragraphs E13-E15, wherein the plurality of discrete marker bodies includes a plurality of elongate marker bodies.

E17. The system of any of paragraphs E13-E16, wherein the marker material includes a first marker material and a second marker material, optionally wherein the first marker material is distributed in a different portion of the subterranean structure than the second marker material, and further optionally wherein the detector is configured to determine which of the first marker material and the second marker material is present at an intersection point between the wellbore and the subterranean structure.

E18. The system of paragraph E17, wherein the first marker material is distributed within the subterranean structure in a ring around the second marker material.

E19. The system of any of paragraphs E1-E18, wherein the marker material includes at least one of a micromarker, an RFID device, a WID device, an LW device, an active device, a passive device, a micromaterial, an electromagnetic material, a fluorescent material, a radioactive material, and a piezoelectric material.

E20. The system of any of paragraphs E1-E19, wherein the system includes the wellbore.

E21. The system of any of paragraphs E1-E20, wherein the wellbore forms a portion of a hydrocarbon well that is configured to convey a hydrocarbon from a subterranean formation that includes the subterranean structure to a surface region.

E22. The system of any of paragraphs E1-E21, wherein the subterranean structure is present within a/the subterranean formation, and further wherein the subterranean formation contains a hydrocarbon.

E23. The system of paragraph E22, wherein the subterranean formation contains at least one of oil shale, tar sands, and organic-rich rock.

E24. The system of any of paragraphs E22-E23, wherein the hydrocarbon includes at least one of kerogen and bitumen.

E25. The system of any of paragraphs E1-E24 when used as part of at least one of a shale oil retort process, a shale oil heat treating process, a hydrogenation reaction, a thermal dissolution process, and an in situ shale oil conversion process within a/the subterranean formation.

E26. The system of any of paragraphs E1-E25, wherein the subterranean structure includes a man-made subterranean structure, and optionally wherein the system includes the subterranean structure.

F1. The use of any of the methods of any of paragraphs A1-D9 with any of the systems of any of paragraphs E1-E26.

F2. The use of any of the systems of any of paragraphs E1-E26 with any of the methods of any of paragraphs A1-D9.

F3. The use of any of the methods of any of paragraphs A1-D9 or any of the systems of any of paragraphs E1-E26 as part of at least one of a shale oil retort process, a shale oil heat treating process, a hydrogenation reaction, a thermal dissolution process, and an in situ shale oil conversion process.

F4. The use of any of the methods of any of paragraphs A1-D9 or any of the systems of any of paragraphs E1-E26 to drill a well.

F5. The use of any of the methods of any of paragraphs A1-D9 or any of the systems of any of paragraphs E1-E26 to form an electrical connection between a granular resistive heater that is present within a subterranean structure and an electric current source.

F6. The use of any of the methods of any of paragraphs A1-D9 or any of the systems of any of paragraphs E1-E26 to heat a subterranean formation.

F7. The use of a marker material as an indicator to detect an intersection of a wellbore with a subterranean structure.

F8. The use of a bulk magnetic susceptibility meter to detect an intersection of a wellbore with a subterranean structure by detecting at least one of a presence of magnetite within the wellbore and a proximity of magnetite to the wellbore.

PCT1. A method of detecting an intersection of a well that includes a wellbore with a subterranean structure, wherein the subterranean structure includes a marker material distributed therein, the method comprising:

drilling the wellbore; and determining that the wellbore has intersected a portion of the subterranean structure that includes the marker material, wherein the determining includes detecting the marker material.

PCT2. The method of paragraph PCT1, wherein the method further includes ceasing the drilling the wellbore, wherein the ceasing is responsive, at least in part, to the detecting.

PCT3. The method of paragraph PCT2, wherein the wellbore includes a terminal depth, and further wherein the ceasing includes ceasing the drilling such that the terminal depth of the wellbore is within 25 mm of a target portion of the subterranean structure.

PCT4. The method of any of paragraphs PCT1-PCT3, wherein the method further includes distributing the marker material within the subterranean structure, wherein the distributing includes injecting the marker material into the subterranean structure from a stimulation well.

PCT5. The method of any of paragraphs PCT1-PCT4, wherein the marker material includes magnetite, and further wherein the detecting includes detecting a bulk magnetic susceptibility of cuttings that are produced while drilling the wellbore.

PCT6. The method of any of paragraphs PCT1-PCT5, wherein the detecting includes detecting the marker material with a logging-while-drilling transducer.

PCT7. The method of any of paragraphs PCT1-PCT6, wherein the wellbore forms a portion of a hydrocarbon well that is configured to convey a hydrocarbon from a subterranean formation that includes the subterranean structure to a surface region, and further wherein the method includes producing a hydrocarbon from the subterranean formation.

PCT8. The method of any of paragraphs PCT1-PCT7, wherein the marker material includes a plurality of discrete marker bodies, and further wherein the detecting includes detecting at least a portion of the plurality of discrete marker bodies.

PCT9. The method of any of paragraphs PCT1-PCT8, wherein the marker material includes a first marker material and a second marker material, wherein the method includes distributing the first marker material in a different portion of the subterranean structure than the second marker material, wherein the detecting includes determining a characteristic of the marker material that is present at an intersection point between the wellbore and the subterranean structure, wherein the characteristic of the marker material includes at least one of an identity of the marker material, a concentration of the marker material, and a ratio of a concentration of the first marker material to a concentration of the second marker material, and further wherein the method includes drilling a second wellbore at a second location, wherein the second location is selected based, at least in part, on the determining.

PCT10. A method of forming an electrical connection between an electric current source and a granular resistive heater that forms a portion of a subterranean structure, the method comprising:

detecting an intersection of a wellbore with the subterranean structure using the method of any of paragraphs PCT1-PCT9;

providing a supplemental material to a portion of the granular resistive heater that is proximal to the wellbore;

forming an electrical connection between the supplemental material and the granular resistive heater; and forming an electrical connection between the supplemental material and an electrical conduit that is configured to convey an electrical current between the granular resistive heater and the electric current source.

PCT11. A method of forming a granular resistive heater, wherein the granular resistive heater forms a portion of a subterranean structure that is present within a subterranean formation, the method comprising:

creating a fracture within the subterranean formation;

supplying a proppant to the fracture, wherein the proppant includes a porous structure that is configured to provide for fluid flow through the fracture, and further wherein the proppant includes a granular resistive heating material that forms the granular resistive heater;

distributing a marker material within the fracture; and forming an electrical connection between an electric current source and the granular resistive heater using the method of any of paragraphs PCT1-PCT10.

PCT12. The method of paragraph PCT11, wherein a length of the granular resistive heater is at least 50 meters, wherein a width of the granular resistive heater is at least 25 meters, and further wherein the granular resistive heater is at least substantially planar.

PCT13. The method of any of paragraphs PCT11-PCT12, wherein the method further includes heating the subterranean formation with the granular resistive heater, wherein the heating includes performing at least one of a shale oil retort process, a shale oil heat treating process, a hydrogenation reaction, a thermal dissolution process, and an in situ shale oil conversion process within the subterranean formation, and further wherein the heating includes converting the hydrocarbon into at least one of a liquid hydrocarbon, a gaseous hydrocarbon, and shale oil.

PCT14. A system configured to detect an intersection of a wellbore with a subterranean structure, the system comprising:

a marker material distributed within the subterranean structure;

a drill string configured to drill the wellbore;

a detector configured to generate an intersection signal responsive to detecting the marker material, wherein the detector includes a logging-while-drilling transducer that is located on the drill string, and further wherein the logging-while-drilling transducer is less than 1 meter from at least one of a drill bit that is associated with the drill string and a terminal end of the drill string; and a control system configured to control the operation of the drill string responsive, at least in part, to the intersection signal.

PCT15. The system of paragraph PCT14, wherein the marker material includes magnetite, and further wherein the detector includes a bulk magnetic susceptibility meter.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of forming an electrical connection between an electric current source and a granular resistive heater that forms a portion of a subterranean structure, the method comprising:

detecting an intersection of a wellbore with the subterranean structure by drilling the wellbore and determining that the wellbore has intersected a portion of the subterranean structure that includes a marker material, wherein the determining includes detecting the marker material;

providing a supplemental material to a portion of the granular resistive heater that is proximal to the wellbore;

forming a first electrical connection between the supplemental material and the granular resistive heater; and forming a second electrical connection between the supplemental material and an electrical conduit that is configured to convey an electrical current between the granular resistive heater and the electric current source.

2. The method of claim 1, further comprising ceasing the drilling the wellbore, wherein the ceasing is responsive to the detecting the intersection.

3. The method of claim 2, wherein the wellbore includes a terminal depth, and wherein the ceasing includes ceasing the drilling such that a terminal depth of the wellbore is within 25 mm of a target portion of the subterranean structure.

4. The method of claim 1, further comprising distributing the marker material within the subterranean structure, wherein the distributing includes injecting the marker material into the subterranean structure from a stimulation well.

5. The method of claim 4, wherein a concentration of the marker material within the subterranean structure is less than 1 volume %.

6. The method of claim 4, wherein the marker material includes a plurality of discrete marker material particles, wherein at least a portion of the plurality of discrete marker material particles includes an elongate structure with a longitudinal axis, and wherein the distributing includes aligning the longitudinal axis, wherein the aligning includes at least one of aligning the longitudinal axis along a common axis and aligning the longitudinal axis parallel to a common plane.

7. The method of claim 6, wherein the aligning includes at least one of flowing the marker material through the subterranean structure, flowing a fluid past the marker material after the marker material is present within the subterranean structure, applying an electric field to the marker material within the subterranean structure, applying a magnetic field to the marker material within the subterranean structure, and self-alignment of the marker material within the subterranean structure.

8. The method of claim 1, wherein the marker material includes magnetite, and wherein the detecting the intersection includes detecting a bulk magnetic susceptibility of cuttings that are produced while drilling the wellbore.

9. The method of claim 8, wherein the magnetite includes discrete magnetite particles, wherein each of the discrete magnetite particles includes magnetic poles including at least a north magnetic pole and a south magnetic pole, and wherein the method further comprises aligning the discrete magnetite particles within the subterranean structure such that a coherent fraction of the discrete magnetite particles is aligned with their north poles pointing within a threshold coherence angle of a same direction, wherein the coherent fraction includes at least 50% of the discrete magnetite particles, and wherein the threshold coherence angle is less than 20 degrees.

10. The method of claim 9, wherein each of the discrete magnetite particles in a single domain fraction of the discrete magnetite particles includes only one magnetic domain, wherein the single domain fraction includes at least 75% of the discrete magnetite particles.

11. The method of claim 9, wherein each of the discrete magnetite particles in a multi-domain fraction of the discrete magnetite particles includes magnetic domains, wherein the multi-domain fraction includes less than 50% of the discrete magnetite particles, and wherein the magnetic domains are aligned with one another to within a threshold alignment angle.

12. The method of claim 1, wherein the detecting the intersection includes detecting the marker material with a logging-while-drilling transducer.

13. The method of claim 12, wherein the logging-while-drilling transducer is located on a drill string, and wherein the logging-while-drilling transducer is less than 1 meter from at least one of a drill bit that is associated with the drill string and a terminal end of the drill string.

14. The method of claim 1, wherein the wellbore forms a portion of a hydrocarbon well that is configured to convey a hydrocarbon from a subterranean formation that includes the subterranean structure to a surface region, and wherein the method further comprises producing a hydrocarbon from the subterranean formation.

15. The method of claim 1, wherein the marker material includes discrete marker bodies, and wherein the detecting the intersection includes detecting at least a portion of the discrete marker bodies.

16. The method of claim 1, wherein the marker material includes a first marker material and a second marker material, and wherein the method further comprises distributing the first marker material in a different portion of the subterranean structure than the second marker material.

17. The method of claim 16, wherein the detecting the intersection includes determining a characteristic of the marker material that is present at an intersection point between the wellbore and the subterranean structure, wherein the characteristic of the marker material includes at least one of an identity of the marker material, a concentration of the marker material, and a ratio of a concentration of the first marker material to a concentration of the second marker material.

18. The method of claim 17, further comprising drilling a second wellbore at a second location, wherein the second location is selected based on the determining.

19. The method of claim 16, wherein the distributing includes creating a ring of the first marker material around the second marker material within the subterranean structure.

20. The method of claim 1, wherein the supplemental material includes at least one of carbon, graphite, a metallic material, a metal particulate, and metal hairs.

21. The method of claim 1, wherein the well is a first well, and wherein the method further comprises repeating the method to form a second electrical connection between the electric current source and the granular resistive heater with a second well.

22. A method of forming a granular resistive heater, wherein the granular resistive heater forms a portion of a subterranean structure that is present within a subterranean formation, the method comprising:

creating a fracture within the subterranean formation;

supplying a proppant to the fracture, wherein the proppant includes a porous structure that is configured to provide for fluid flow through the fracture, and wherein the proppant includes a granular resistive heating material that forms the granular resistive heater;

distributing a marker material within the fracture; and forming an electrical connection between an electric current source and the granular resistive heater using the method of claim 1.

23. The method of claim 22, wherein a portion of the granular resistive heater that is proximal to a stimulation well includes an average stimulation well-proximal thickness, wherein the average stimulation well-proximal thickness is at least 3 mm and less than 12 mm.

24. The method of claim 22, wherein the portion of the granular resistive heater that is proximal to the wellbore includes an average wellbore-proximal thickness, wherein the average wellbore-proximal thickness is at least 0.5 mm and less than 3 mm.

25. The method of claim 22, wherein the granular resistive heating material includes discrete heating material bodies, and wherein an average characteristic dimension of the discrete heating material bodies is at least 50 micrometers and less than 200 micrometers.

26. The method of claim 22, wherein a length of the granular resistive heater is at least 50 meters, wherein a width of the granular resistive heater is at least 25 meters, and wherein the granular resistive heater is at least substantially planar.

27. The method of claim 22, further comprising heating the subterranean formation with the granular resistive heater, wherein the heating includes performing at least one of a shale oil retort process, a shale oil heat treating process, a hydrogenation reaction, a thermal dissolution process, and an in situ shale oil conversion process within the subterranean formation, and wherein the heating includes converting the hydrocarbon into at least one of a liquid hydrocarbon, a gaseous hydrocarbon, and shale oil.

* * * * *